US007644526B2

(12) United States Patent
Kasuya

(10) Patent No.: US 7,644,526 B2
(45) Date of Patent: Jan. 12, 2010

(54) EXTENDING TOOL OF SHEET-LIKE MATERIAL

(76) Inventor: Furetsu Kasuya, 8-14, Tsudamachi 1-chome, Kodaira-shi, Tokyo 187-0025 (JP)

( * ) Notice: Subject to any disclaimer, the term of this patent is extended or adjusted under 35 U.S.C. 154(b) by 0 days.

(21) Appl. No.: 12/223,441

(22) PCT Filed: Feb. 8, 2007

(86) PCT No.: PCT/JP2007/052211

§ 371 (c)(1),
(2), (4) Date: Jul. 31, 2008

(87) PCT Pub. No.: WO2007/091630

PCT Pub. Date: Aug. 16, 2007

(65) Prior Publication Data

US 2009/0031593 A1 Feb. 5, 2009

(30) Foreign Application Priority Data

Feb. 8, 2006 (JP) ..... 2006-031145

(51) Int. Cl.
*D05C 1/02* (2006.01)
*D06C 3/08* (2006.01)

(52) U.S. Cl. ..... 38/102.4; 38/102.91

(58) Field of Classification Search ..... 38/102, 38/102.1, 102.3, 102.4, 102.5, 102.8, 102.91; 101/127.1; 160/382, 372, 371, 374.1, 375, 160/376, 378, 381
See application file for complete search history.

(56) References Cited

U.S. PATENT DOCUMENTS 3,482,343 A 12/1969 Hamu
3,485,165 A 12/1969 Hughes
3,914,887 A * 10/1975 Newman ..... 38/102.8
3,949,500 A * 4/1976 Connors ..... 38/102.5

(Continued)

FOREIGN PATENT DOCUMENTS

JP 55-136533 9/1980

(Continued)

OTHER PUBLICATIONS

International Search Report issued May 22, 2007 in the International (PCT) Application of which the present application is the U.S. National Stage.

*Primary Examiner*—Ismael Izaguirre
(74) *Attorney, Agent, or Firm*—Wenderoth, Lind & Ponack, L.L.P.

(57) ABSTRACT

An extension tool is provided for stretching a sheet-shaped material over its entirety with minimal adjusting portions and uniform tension. Four corner members are disposed along with four frame members for forming a rectangular frame. Four rods are disposed so as to pass through the four frame members and allow the sides and corners to move towards and away from each other for adjusting the size of the frame. One set of corner members are located on the diagonals and are provided with a moving mechanism for moving the rods along the sides of the rectangle. The extension tool for tensioning the material further comprises a transmission mechanism for converting the movement of a rod in a first side of the rectangle between first corner pairs into a reversing and approaching movement of a second rod in a second side of the frame between second corner pairs.

20 Claims, 25 Drawing Sheets

U.S. PATENT DOCUMENTS

| | | | | | |
|---|---|---|---|---|---|
| 4,144,660 | A | * | 3/1979 | Lamb | 38/102.5 |
| 4,625,440 | A | * | 12/1986 | Dang et al. | 38/102.5 |
| 5,076,162 | A | | 12/1991 | Goin | |
| 5,113,611 | A | | 5/1992 | Rosson | |
| 5,163,367 | A | * | 11/1992 | Newman | 101/127.1 |
| 5,265,534 | A | | 11/1993 | Hamu | |
| 5,271,171 | A | | 12/1993 | Smith | |
| 5,802,971 | A | | 9/1998 | Hamu et al. | |
| 6,427,588 | B1 | | 8/2002 | Kline | |
| 6,497,268 | B1 | * | 12/2002 | Peppett | 160/374.1 |

FOREIGN PATENT DOCUMENTS

| | | |
|---|---|---|
| JP | 1-141027 | 9/1989 |
| JP | 2-19532 | 2/1990 |
| JP | 11-500076 | 1/1999 |
| JP | 2002-239849 | 8/2002 |
| JP | 2004-262216 | 9/2004 |
| WO | 92/03231 | 3/1992 |
| WO | 96/25239 | 8/1996 |
| WO | 02/055304 | 7/2002 |

* cited by examiner (a)

(b)

(a)

(b)

(a)

(b)

EXTENDING TOOL OF SHEET-LIKE MATERIAL

BACKGROUND OF THE INVENTION

1. Field of the Invention

The present invention relates to a frame with a new structure where a screen to be used in screen printing is stretched.

The invention also relates to an extension tool for the purpose of stretching a sheet-like material, e.g., a sheet-shaped or mesh material made of metal, resin, etc. to be used in screen printing, a sheet-shaped material such as a canvas to be used for a texture in oil painting, or a sheet-shaped material such as leather to be stretched on a percussion instrument body such as a drum.

2. Description of the Related Art

A screen printing screen sheet with a relatively simple structure has been conventionally used, in which a metal mesh with lower elasticity for a portion where an image is to be formed is arranged at the central portion of the screen and a mesh with a relatively higher elasticity is disposed on the periphery of the portion where the image is to be formed as a support member.

For a screen, elasticity and expandability are entirely different, depending on the size of the portion where the image is to be formed or depending on the material used for the screen. In this respect, it is extremely necessary to adjust the screen for preparing the screen to suit the purpose required on the object to be printed, and this adjustment is difficult to carry out.

The screen for screen printing is stretched by applying tension to the screen. For this reason, a screen frame must have sufficient strength to endure the tension, and wooden or metal material having high strength is used. Accordingly, the screen frame is weighty and bulky.

A screen frame needs a large-scale pulling means when adjusting the length of the screen frame sides, and because a large-scale pulling means must be used, the structure is not very convenient to handle.

Also, it is not always easy to stretch the screen or to adjust the tension on the spread screen by combining the screen frame for freely adjusting the length of each side of the screen frame with a tool used to fix the screen. Also, it is difficult to freely attach or remove the means to which the screen is fixed.

Further, in a case where the object to be printed is distorted or has unevenness in the extension of the screen, or in a case where distortion or deviation occurs in an embossed printing, it is difficult to attain a high degree of accuracy in printing by compensating or adjusting based on these problems.

Once the screen has been fixed on the screen frame, it is further difficult to adjust the distortion or deviation of images.

The conventional tool for stretching a sheet-shaped material comprising an expandable frame body has been practiced as adjusting the positions of four sides of the frame respectively to change the distance between the frame sides so as to adjust the tension of the sheet-shaped material stretched on the extension tool.

A frame with a plurality of mechanisms for finely adjusting the tension on the stretched screen is disclosed in Japanese Laid-Open Utility Model Application No. 1-141027, Japanese Laid-Open Utility Model Application No. 55-136533 and International Patent Publication WO 92/03231.

A frame in which a screen is fixed on a support frame by an anchor pin to add tension in advance to the screen, the support frame is attached to an extension frame and the tension is adjusted by a screw, is disclosed in U.S. Pat. No. 3,482,343, U.S. Pat. No. 3,485,165 and U.S. Pat. No. 6,427,588.

A frame for stretching a screen, in which the screen is fixed on a support frame by using grooves and fixing members, the support frame is mounted on the frame for stretching the screen and the length of frame sides is changed by using a screw mechanism or a fluid cylinder on the frame, is disclosed in U.S. Pat. No. 5,113,611.

A frame, in which the tension is finely adjusted by rotating the frame where the screen is stretched, is disclosed in U.S. Pat. No. 5,076,162, U.S. Pat. No. 5,271,171 and U.S. Pat. No. 5,265,534.

A frame, in which tension is added in advance by fixing the screen on a support frame by using an adhesive agent and the support frame is attached to the frame by means of an anchor and the frame is finely adjusted by rotating a screw or a frame member, is disclosed in U.S. Pat. No. 5,802,971.

In these types of screen extension frames, there are many points to be adjusted. Also, when adjustment is made at a point, the tension on other points is also changed, and thus it is difficult to stretch the sheet-shaped material over its entirety under the tension as desired. This means that a long period of time is required for adjusting the tension. Further, when the screen is mounted on the frame, a lot of time and labor are required for the operations of mounting and removing.

Under such circumstances, the present inventor has developed, as shown in International Patent Publication WO 02/55304, an extension tool with a new structure, in which it is possible to easily adjust the tension by using four mechanisms.

SUMMARY OF THE INVENTION

It is an object of the present invention to provide an extension tool for a sheet-shaped material, by which it is possible to easily stretch the sheet-shaped material as practical as possible and to stretch the sheet-shaped material over its entirety by uniform tension at relatively fewer adjusting points.

To attain the above object, the present invention provides a tool for stretching a sheet-shaped material, which comprises a basic configuration of four corner members each disposed at a corner of a rectangle; four frame members, both ends of which are supported by corner members and are disposed between two opposite corner members respectively, in which each of the four frame members can move between the opposite corner members in a direction toward the opposite corner member and can move in a direction to approach to or in a direction away from the opposed frame member together with the two opposite corner members, which support both ends of the frame member; and four solid rods passing through each of the frame members and placed respectively between two opposite corner members, where each of the frame members or each of the corner members has an anchoring element to which the peripheral edge of the sheet-shaped material is anchored.

In the extension tool for a sheet-shaped material according to the present invention in any of the arrangements as described above, it can be so designed that a moving mechanism is mounted at a corner of the corner member, having an insert, which can move in a direction of the corner toward the inner side of a rectangle formed by the four corner members, and a ball. The ball is movably disposed in a space, which is formed between a forward end of the insert and an each end of each rod, which is placed between the corner member provided with the moving mechanism and the opposite corner member, where the end of the rod is closer to the corner member with the moving mechanism, so that the ball is interposed between the forward end of the insert and the end of each rod and is always abutted to the end of each rod closer to the corner member with the moving mechanism.

In this case, on the corner member with the moving mechanism, a stopper can be provided, which limits the movement of the insert in a direction toward the inner side of a rectangle formed by the four corner members.

In the basic arrangement of the present invention as described above, a further arrangement as will be described below is proposed. One corner member among the four corner members is provided with a moving mechanism, which is always in abutment with an end of a rod disposed between the corner member and one of the two opposite corner members, and which moves the rod in a direction toward the one of the two opposite corner members, and there is a fixed connection to an end of the rod which is disposed between the corner member and the other of the two opposite corner members.

Also, a transmission mechanism is provided, where the movement of either one of the two rods, which extend toward each of the corner members other than the corner member provided with the moving mechanism, is converted to the movement of the other rod in a direction away from each of the corner members, and also, where the movement of either one of the two rods in a direction away from each of the corner members is followed by movement of the other rod in a direction toward each of the corner members.

In the extension tool for a sheet-shaped material in any of the arrangements as described above according to the present invention, it can be so designed that each of the four frame members has a hollow portion, and four solid rods, each of which passes through the frame member and is disposed between two opposite corner members, are supported in the hollow portion respectively by support members which are placed in the hollow portion of the frame member and are disposed with a predetermined distance from each other.

According to the present invention, a sheet-shaped material, such as a sheet or a mesh made of metal, resin, etc., as used in screen printing can be easily stretched on the screen extension frame, over the uniform tension even at fewer adjusting points.

REFERENCE NUMERALS

Figure 1:
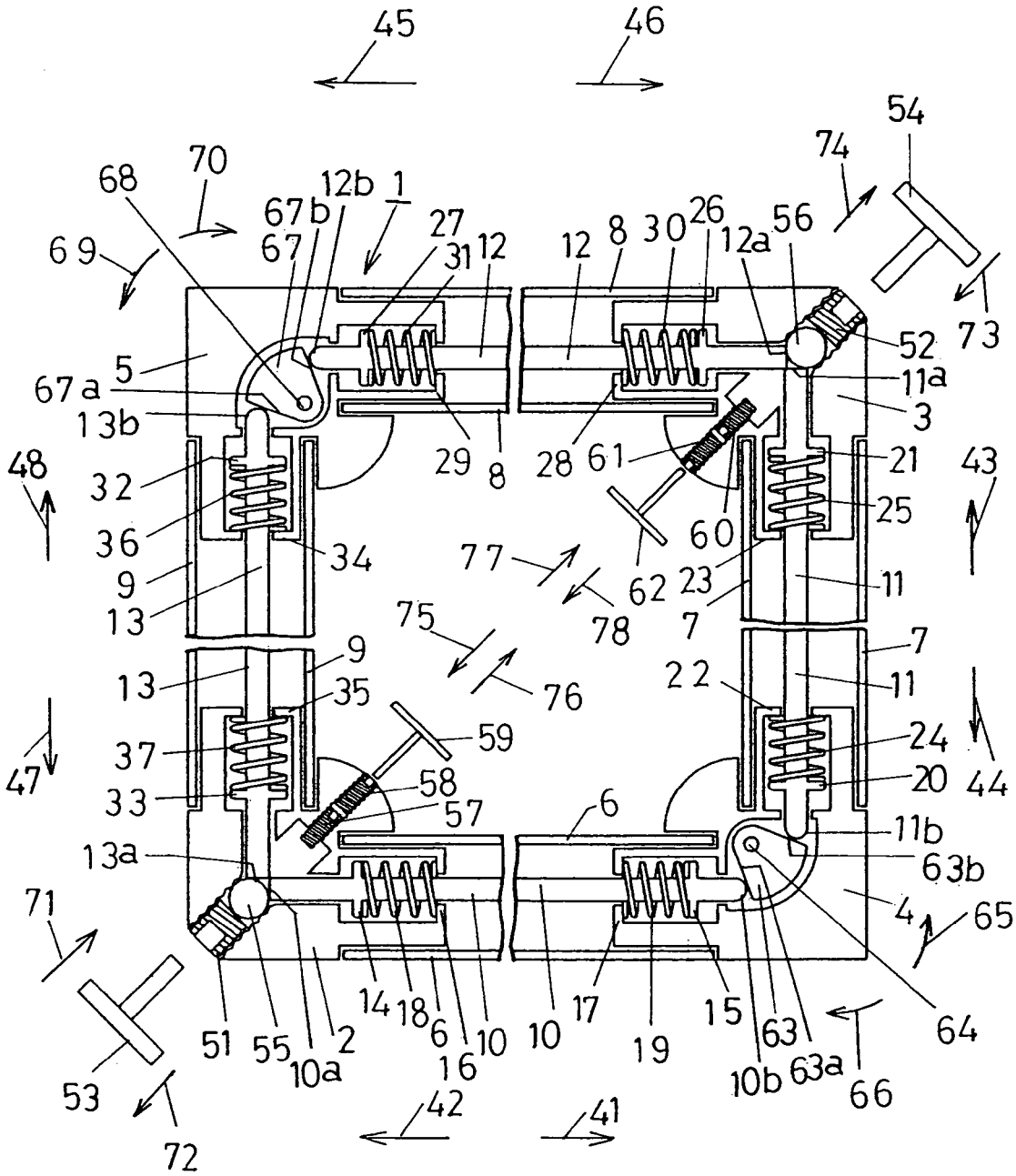
FIG. 1 is a schematic drawing showing an extension tool according to the present invention.

1 an extending tool of a sheet-like material
2, 3, 4, 5 a corner member
6, 7, 8, 9 a frame member
6*a*, 7*a*, 8*a*, 9*a* an inner piece
10, 11, 12, 13 a rod
10*a* an end of a rod 10
10*b* an end point of a rod 10
11*a* an end of a rod 1
11*b* an end point of a rod 11
12*a* an end of a rod 12
12*b* an end point of a rod 12
13*a* an end of a rod 13
13*b* an end point of a rod 13
14, 15, 20, 21, 26, 27, 32, 33 a collar
18, 19, 24, 25, 30, 31, 36, 37 a spring
16, 17, 22, 23, 28, 29, 34, 35 an outer edge of a corner member
51, 51*a*, 52, 52*a* an insert
53, 54, 59, 62 a T-shaped wrench
55, 56 a ball
57, 58, 60, 61 a screw

63, 67 a cam
63*a* a side surface of a cam 63
63*b* another side surface of a cam 63
64, 68 a support shaft
67*a*, 67*b* a side surface of a cam 67
90 an engaging projection
91*a* sheet-shaped material
92, 93 an engaging hole
96 a ridge to engage with a groove 97
97 a groove disposed on a peripheral edge of a sheet-shaped material 91
98 a groove to engage with a ridge 99
99 a ridge disposed on a peripheral edge of a sheet-shaped material 91
104, 105 a corner member
114, 115, 120 a linking piece
116, 117, 118, 119 a pin
131 an anchoring hole provided on each of four corners of a sheet-shaped material 91
130 a projection disposed on the upper side of a corner member
103*b*, 103*a*, 204*a*, 204*b*, 205*a*, 205*b* a groove
104, 105 a corner member
106, 107, 108 a linking piece
109, 110, 111, 112 a pin
204, 205, 303 a corner member

DETAILED DESCRIPTION OF THE PREFERRED EMBODIMENTS

Description will be given below of preferred embodiments of the invention with reference to the accompanying drawings.

Figure 2:
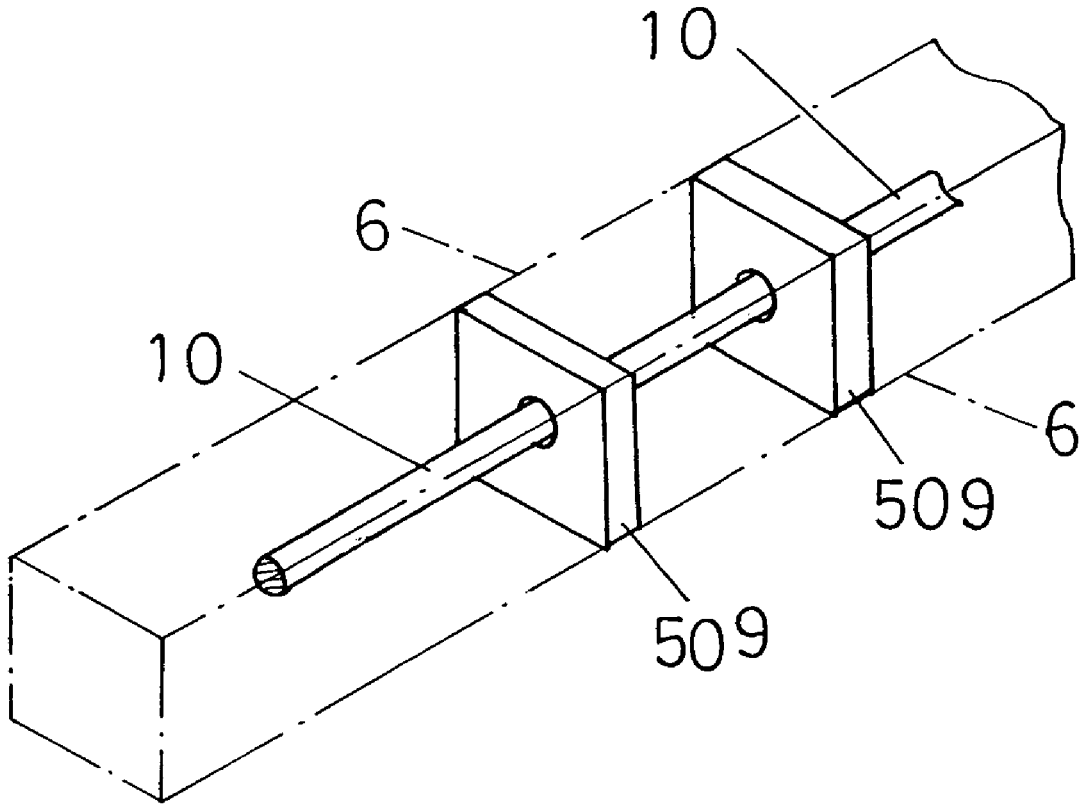
FIG. 2 is a perspective view showing support members of a rod in the extension tool of the present invention.

Referring to FIG. 1 and FIG. 2, a first embodiment of the extension tool for a sheet-shaped material according to the present invention is described.

An extension tool 1 for a sheet-shaped material comprises four corner members 2, 3, 4 and 5; four frame members 6, 7, 8 and 9; and four rods 10, 11, 12 and 13. Each of the rods is solid as shown in FIG. 2. The four corner members 2, 3, 4 and 5 are placed each at a corner of a rectangle, and four frame members 6, 7, 8 and 9 are disposed respectively between two opposite corner members.

The frame member 6 is movable in directions toward the opposite corner members 4 and 2, respectively; the frame member 7 is movable in directions toward the opposite corner members 3 and 4, respectively; the frame member 8 is movable in directions toward the opposite corner members 5 and 3, respectively; and the frame member 9 is movable in directions toward the opposite corner members 2 and 5, respectively.

Each of the frame members 6, 7, 8 and 9 is supported respectively at both ends by the opposite corner members. As a result, the frame member 6 can be moved in a direction to approach or in a direction away from the opposed frame member 8 together with the two opposite corner members 2 and 4, which support both ends of the frame member 6; the frame member 8 can be moved in a direction to approach or in a direction away from the opposed frame member 6 together with the two opposite corner members 3 and 5, which support both ends of the frame member 8; the frame member 7 can be moved in a direction toward the opposed frame member 9 together with the two opposite corner members 4 and 3, which support both ends of the frame member 7; and the frame member 9 can be moved in a direction toward the opposed frame member 7 together with the two opposite corner members 5 and 2, which support both ends of the frame 9. Reference numerals 41 to 48 each represents an arrow mark to indicate the moving direction respectively.

The rods 10, 11, 12 and 13 are disposed so as to pass through each of the frame members 6, 7, 8 and 9 respectively between the two opposite corner members. The rod 10 is provided with collars 14 and 15 at positions closer to both ends, respectively. An elastic member 18 such as a spring is disposed between the collar 14 and an outer edge 16 of the corner member 2. An elastic member 19 such as a spring is disposed between the collar 15 and an outer edge 17 of the corner member 4. One end of the rod 10 is pushed in a direction toward the corner member 2 and the other end of the rod 10 is pushed in a direction toward the corner member 4 by these elastic members 18 and 19.

The rod 11 is provided with collars 20 and 21 at positions closer to its both ends respectively. An elastic member 24 such as a spring is disposed between the collar 20 and an outer edge 22 of the corner member 4, and an elastic member 25 such as a spring is disposed between the collar 21 and an outer edge 23 of the corner member 3. By these elastic members 24 and 25, one end of the rod 11 is pushed in a direction toward the corner member 4, and the other end of the rod 11 is pushed in a direction toward the corner member 3.

The rod 12 is provided with collars 26 and 27 at positions closer to its both ends respectively. An elastic member 30 such as a spring is disposed between the collar 26 and an outer edge 28 of the corner member 3. An elastic member 31 such as a spring is disposed between the collar 27 and an outer edge 29 of the corner member 5. By these elastic members 30 and 31, one end of the rod 12 is pushed in a direction toward the corner member 3, and the other end of the rod 12 is pushed in a direction toward the corner member 5.

The rod 13 is provided with collars 32 and 33 at positions closer to its both ends respectively. An elastic member 36 such as a spring is disposed between the collar 32 and an outer edge 34 of the corner member 5. An elastic member 37 such as a spring is disposed between the collar 33 and an outer edge 35 of the corner member 2. By these elastic members 36 and 37, one end of the rod 13 is pushed in a direction toward the corner member 5, and the other end of the rod 13 is pushed in a direction toward the corner member 2. Each of the elastic members 18, 19, 24, 25, 30, 31, 36 and 37 has, therefore, equal force to push back the collar of the rod and the outer edge of the corner member in a direction to separate them from each other.

Each of the frame members 6, 7, 8 and 9 has engaging projections each to engage with each of engaging holes formed on the peripheral edge of the sheet-shaped material to be stretched, and an anchoring element, which is a ridge to be engaged with a groove or a groove to be engaged with a ridge.

A pair of the corner members 2 and 3 is abutted respectively to an end of each of the rods 10, 11, 12 and 13, which are disposed between the other pair of the corner members 4 and 5 respectively, and moves the rods 10, 11, 12 and 13 in directions toward the opposite corner members 4 and 5.

The corner member 2 is abutted to an end 10*a* of the rod 10, which is disposed between the corner member 2 and the corner member 4, moves the rod 10 in a direction toward the corner member 4, and it is also abutted to an end 13*a* of the rod 13 disposed between the corner member 2 and the corner member 5, and moves the rod 13 in a direction toward the corner member 5.

The corner member 3 is abutted to an end 11*a* of the rod 11, which is disposed between the corner member 3 and the corner member 4, moves the rod 11 in a direction toward the corner member 4, and it is also abutted to an end 12*a* of the rod 12 disposed between the corner member 3 and the corner member 5, and moves the rod 12 in a direction toward the corner member 5.

The corner member 2 is provided with a moving mechanism, which is mounted at a corner of the corner member 2, and which comprises an insert 51 that is movable in direction of the corner connecting to the point of the inner side of a rectangle formed by four corner members 2, 3, 4 and 5 as shown by arrow marks 71 and 72, and a ball 55.

The insert 51 is, for instance, a screw inserted into a female screw hole which is disposed at the corner of the corner member 2.

The ball 55 is movably disposed in a space, which is formed between a forward end of the insert 51 and the end 10*a* and the end 13*a* which are the closer ends of the rod 10 and the rod 13 to the corner member 2.

The ball 55 is interposed between the forward end of the insert 51 and the end 10*a* of the rod 10 and the end 13*a* of the rod 13 respectively so that the ball 55 abuts the forward end of the insert 51, the end 10*a*, the end 13*a* of the rod 10 and the rod 13 closer to the corner member 2, respectively.

The moving mechanism provided on the corner member 3 is mounted at a corner of the corner member 3 and has an insert 52, which is movable in direction of the corner connecting to the point of the inner side of a rectangle formed by four corner members 2, 3, 4 and 5 as shown by arrows 73 and 74; and a ball 56. The insert 52 is a screw to be inserted into a female screw hole disposed at the corner of the corner member 3 in the embodiment shown in the figure.

The ball 56 is movably disposed in a space, which is formed by the forward end of the insert 52, and each of the ends 11*a* and 12*a* of the rod 11 and the rod 12, respectively. The ball 56 is interposed between the forward end of the insert 52, the end 11*a* of the rod 11 and the end 12*a* of the rod 12, respectively so that it is always in abutment, as shown in FIG. 1, with the forward end of the insert 52, and the end 11*a* and the end 12*a* of the rod 11 and the rod 12, respectively.

By the ball 55 being movably disposed in a space, which is formed between the forward end of the insert 51, and the end 10*a* of the rod 10 and the end 13*a* of the rod 13, respectively, the force to be transmitted to the rod 10 and the force to be transmitted to the rod 13 are maintained uniformly when the insert 51 is moved.

On the corner member 3, there is provided a moving mechanism, which is mounted at a corner of the corner member 3 and comprises an insert 52 that is movable in direction of the corner connecting to the point of the inner side of a rectangle formed by four corner members 2, 3, 4 and 5 as shown by arrows 73 and 74, and a ball 56.

The insert 52 is, for instance, a screw inserted into a female screw hole which is disposed at the corner of the corner member 3.

The ball 56 is movably disposed in a space, which is formed between the forward end of the insert 52, and the end 11*a* and the end 12*a* which are the closer ends of the rod 11 and the rod 12 to the corner member 2.

The ball 56 is interposed between the forward end of the insert 52, and the end 11*a* and the end 12*a* of the rod 11 and the rod 12, respectively so that it is in abutment with the forward end of the insert 52 and the end 11*a* of the rod 11 and the end 12*a* of the rod 12, respectively.

By the ball 56 being movably disposed in a space, which is formed between the forward end of the insert 52, and the end 11*a* of the rod 11 and the end 12*a* of the rod 12, the force to be transmitted to the rod 11 and the force to be transmitted to the rod 12 are maintained uniformly when the insert 52 is moved.

The extension tool 1 of the sheet-shaped material according to the present invention further comprises a transmission mechanism as will be described below.

By the transmission mechanism, the movement of either one of the two rods 10 and 11 or of the two rods 12 and 13 extending toward each of the corner members 4 and 5, which are opposite to the set of the diagonally opposed corner members 2 and 3 provided with the moving mechanism, in a direction toward the respective opposite corner members 4 and 5 is converted to movement of the other rod in direction away from the respective opposite corner members 4 and 5. Also, it is designed so that the movement of either one of the two rods in a direction away from the respective opposite corner members 4 and 5 is followed by movement of the other rod in a direction toward the respective opposite corner members 4 and 5.

This transmission mechanism on the corner member 4 opposite to the set of the diagonally opposed corner members 2 and 3 where the moving mechanism is provided, has a cam 63, which is rotatably mounted on a support shaft 64 fixed on the corner member 4. An end 10*b* of the rod 10 is abutted to a side surface 63*a* of the cam 63, and an end 11*b* of the rod 11 is abutted to the other side surface 63*b* of the cam 63.

The transmission mechanism on the corner member 5 has a cam 67, which is rotatably mounted on a support shaft 68 fixed on the corner member 5. The end 13*b* of the rod 13 abuts a side surface 67*a* of the cam 67, and the end 12*b* of the rod 12 abuts the other side surface 67*b* of the cam 67.

As described above, the moving mechanism disposed on the corner member 2 has the insert 51 and the ball 55. The ball 55 is in the space, which is formed between the forward end of the insert 51 and the end 10*a* of the rod 10 and the end 13*a* of the rod 13, respectively so that it can be always be in abutment with the forward end of the insert 51 and the end 10*a* of the rod 10 and the end 13*a* of the rod 13, respectively and be movably interposed between the forward end of the insert 51, the end 10*a* of the rod 10 and the end 13*a* of the rod 13.

By the actions of the aforementioned springs 18 and 19, the rod 10 is always pushed in a direction toward the corner member 2 (a direction indicated by an arrow 42) on the one hand, and to move in a direction toward the corner member 4 (a direction indicated by an arrow 41) on the other hand.

Further, by the actions of the aforementioned springs 36 and 37, the rod 13 is always pushed in a direction toward the corner member 2 (a direction indicated by an arrow 47) on the one hand, and to move in a direction toward the corner member 5 (a direction indicated by an arrow 48) on the other hand.

As shown in FIG. 1, a T-shaped wrench 53 is inserted into the insert 51 to rotate it, and the insert 51 is moved forward in a direction indicated by the arrow 71. In this case, if it is supposed that the force required to move the rod 13 in a direction indicated by the arrow 48 is weaker than the force required to move the rod 10 in a direction indicated by the arrow 41, the pushing force caused by the forward movement of the insert 51 in the direction indicated by the arrow 71 is used to move the rod 13 in the direction indicated by the arrow 48. Then, the rod 10 is moved in a direction indicated by the arrow 42 while the end 10*a* abuts the ball 55 due to the action of the spring 18.

In this way, when the force required to move the rod 10 in the direction indicated by the arrow 41 and the force required to move the rod 13 in the direction indicated by the arrow 48 become even, the pushing force caused by the forward movement of the insert 51 in the direction indicated by the arrow 71 is equally distributed to the rod 13 in the direction of the arrow 48 and to the rod 10 in the direction of the arrow 41. As a result, the rod 10 and the rod 13 begin to be pushed by the equal force to move in directions indicated by the arrows 48 and 41, respectively.

On the other hand, when the T-shaped wrench 53 is inserted into the insert 51 and the insert 51 is rotated in reverse direction, the insert 51 is moved backward in the direction indicated by the arrow 72. Here, it is supposed that the force, by which the rod 10 is abutted to the ball 55, is stronger than the force, by which the rod 13 is abutted to the ball 55, with the backward movement of the insert 51 in the direction of the arrow 72, the rod 10 is moved in a direction indicated by the arrow 42 as the end 10*a* of the rod 10 remains in abutment with the ball 55.

When the force to make the rod 10 be abutted to the ball 55 and the force to make the rod 13 be abutted to the ball 55 becomes being even, the rod 10 and the rod 13 begin to move uniformly in the directions indicated by the arrows 42 and 47, respectively with the backward movement of the insert 51 in the direction of the arrow 72.

Then, by the action of the transmission mechanism as described above, if, for example, the rod 13 is moved in the direction of the arrow 48, the cam 67 is rotated in the direction of the arrow 70 around the support shaft 68, and the rod 12 is moved in the direction of the arrow 46. That is, the movement of the rod 13, which is extending toward the corner member 5, in a direction toward the corner member 5 is converted to movement of the other rod 12 in a direction away from the corner member 5.

In the extension tool according to the present invention, the moving mechanism is disposed on the set of the diagonally opposed corner members 2 and 3, respectively and always abuts the ends 10*a*, 13*a*, 11*a* and 12*a* of the rods 10, 13, 11 and 12 which are placed between the corner members 2 and 3 and the respective opposite corner members 4 and 5. The moving mechanism moves the rods 10, 13, 11 and 12 in the direction, respectively, toward the respective opposite corner members 4 and 5 as described above.

The moving mechanism is mounted at a corner of each of the corner members 2 and 3, and it comprises the insert 51 or 52 movable in a direction of the corner connecting to the point of the inner side of a rectangle formed by the four corner members 2, 3, 4 and 5, and the ball 55 or 56.

The balls 55 and 56 are movably disposed respectively in a space, which is formed between the forward end of the inserts 51 or 52 and the ends 10*a* and 13*a* or 11*a* and 12*a* which are ends of the rods 10, 13, 11 and 12 placed between the corner members 2 and 3 with the moving mechanism respectively and the opposite corner members 4 and 5 and which are closer to the corner members 2 and 3 with the moving mechanism, respectively. The balls 55 and 56 are interposed respectively between the forward ends of the insert 51 or 52 and the ends 10*a* and 13*a*, or 11*a* and 12*a* of the rods 10, 13, 11 and 12 so that the balls are abutted respectively to the forward ends of the insert 51 or 52 and to the ends of the rods 10 and 13, or 11 and 12 closer to the corner member 2 or 3 where the moving mechanism is provided.

As a result, the force can be applied to each of the rods 10, 13, 11 and 12 by maintaining the delicate balance of the force.

A stopper is disposed on each of the corner members 2 and 3 provided with the moving mechanism. The stoppers limit the movement of the inserts 51 and 52 in directions as indicated by the arrows 71 and 73 toward the inner side of a rectangle formed by the four corner members 2, 3, 4 and 5.

The stopper comprises screws 57 and 58 inserted into a female screw hole at the corner on the inner side of the corner member 2 or screws 60 and 61 inserted into a female screw hole at the corner on the inner side of the corner member 3.

As shown in FIG. 2, each of the frame members 6, 7, 8 and 9 has a hollow portion inside. It is so designed that each of the four rods 10, 11, 12 and 13 placed between two opposite corner members respectively and passing through each of the frame members 6, 7, 8 and 9 is supported in the hollow portion between two opposite corner members by support members 509, which are disposed in the hollow portion of each of the frame members 6, 7, 8 and 9 with a certain predetermined distance between them.

In the frame member 6 having the hollow portion with a rectangular cross-section, the support members 509 made of synthetic resin and having an outer peripheral shape to match the cross-sectional shape of the inner wall of the frame member 6 are disposed with a certain predetermined distance to each other between the opposite corner members 2 and 4. The rod 10 is supported by the support members 509 because the rod 10 passes the through-holes provided at the center of each of the support members 509.

With the structural features as described above, the rods 10, 11, 12 and 13 can be supported in a stable manner even when the rods may be too long or the rods may be easily bent. As a result, it is possible to support the rods 10, 11, 12 and 13 between the two opposite corner members without bending and in stable manner, while the weight of each of the rods 10, 11, 12 and 13 is reduced to reduce the weight of the extension tool 1, accordingly.

By the action of the transmission mechanism as described above, when the rod 10 is moved in a direction indicated by the arrow 42, for instance, the cam 63 is rotated in a direction of the arrow 66 around the support shaft 64 and the rod 11 is moved in a direction of the arrow 44. That is, the movement of one rod 10 of the two rods 10 and 11, which are extending toward the corner member 4, in a direction away from the corner member 4 is followed by the movement of the other rod 11 in a direction toward the corner member 4.

Similarly, when the rod 13 is moved in a direction of the arrow 47, the cam 67 is rotated in a direction of the arrow 69 around the support shaft 68, and the rod 12 is moved in a direction of the arrow 45. That is, by the action of the transmission mechanism, the movement of one rod 13 of the two rods 12 and 13, which are extending toward the corner member 5, in a direction away from the corner member 5 is followed by the movement of the other rod 12 in a direction toward the corner member 5.

Also, when the rod 10 is moved in a direction of the arrow 41, the cam 63 is rotated in the direction of the arrow 65 around the support shaft 64, and the rod 11 is moved in the direction of the arrow 43. That is, by the action of the transmission mechanism, the movement of one rod 10 of the two rods 10 and 11, which are extending toward the corner member 4, in a direction toward the corner member 4 is converted to the movement of the other rod 11 in a direction away from the corner member 4.

In the above, description has been provided mainly on the moving mechanism that is disposed on the corner member 2, while the moving mechanism may be similarly arranged in the corner member 3, which is disposed at the position opposite diagonally to the corner member 2, and similar operation may be carried out.

By using T-shaped wrenches 59 and 62, the screws 57 and 58 can be moved in a direction indicated by the arrow 75 or the arrow 76, or the screws 60 and 61 are moved in a direction indicated by the arrow 77 or the arrow 78, respectively, and the force to push the inserts 51 and 52 in the directions of the arrows 71 and 73 can be adjusted.

According to the extension tool of the present invention, it is possible to provisionally anchor the sheet-shaped material in an anchoring element on each of the frame members and to easily stretch the sheet-shaped material by moving the rods 10, 11, 12 and 13 in directions indicated by the arrows 41, 42, 43, 44, 45, 46, 47 or 48 by means of the moving mechanism as described above.

Also, by the actions of the moving mechanism and the transmission mechanism as described above, it is possible to adjust the tension at fewer adjusting points, i.e., to stretch the sheet-shaped material by uniform tension over its entirety by moving the rod 10 or the like while maintaining the delicate balance by only the few operation steps of the moving mechanism.

Figure 3:
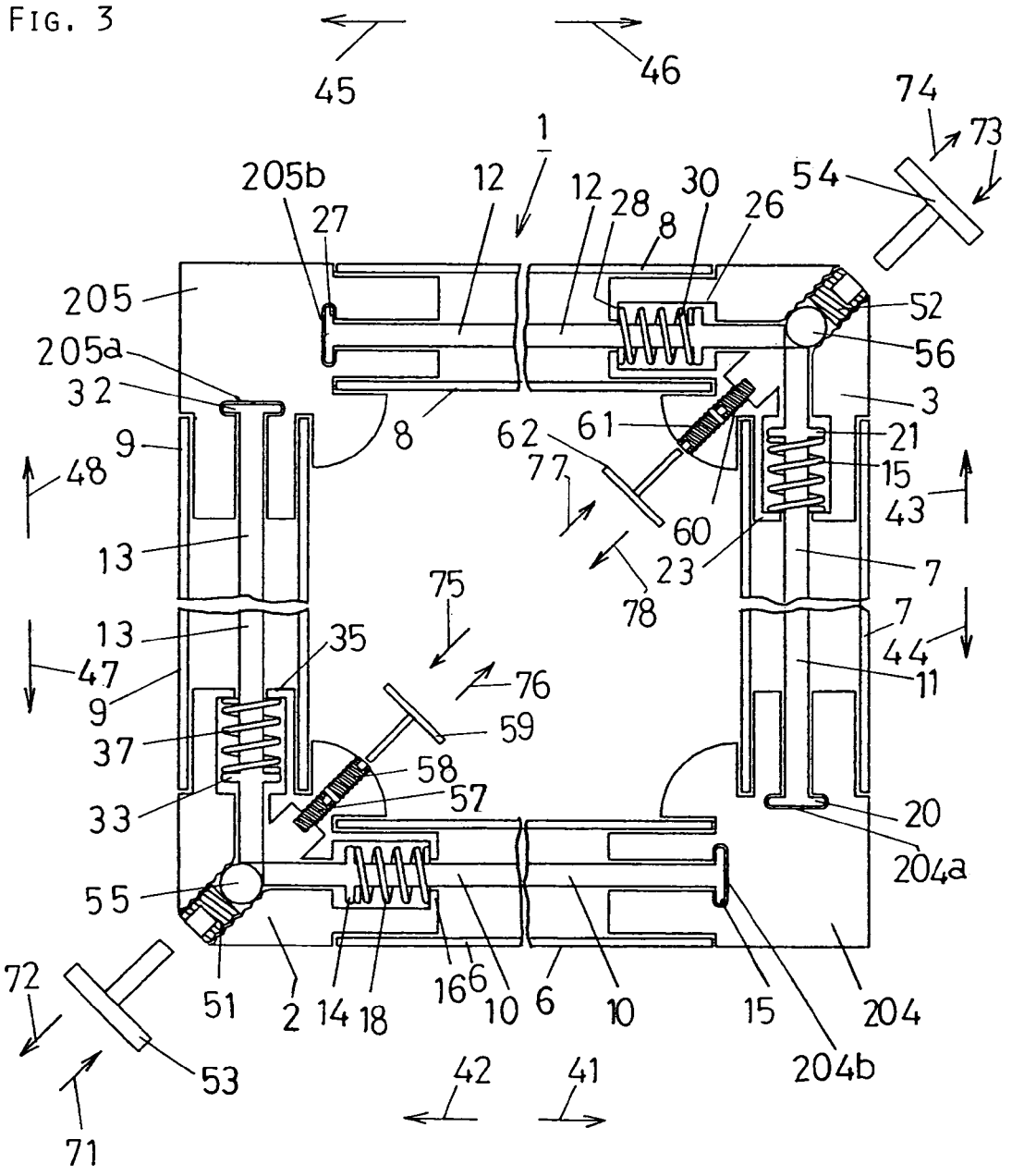
FIG. 3 is a schematic drawing of another example of the extension tool according to the present invention.

Referring to FIG. 3, a second embodiment will be described. The same component elements as those of the first embodiment shown in FIG. 1 are denoted by the same reference numerals, and the detailed description is not given here.

The second embodiment is different from the first embodiment in the following points: the rods 10, 11, 12 and 13, which extend toward the opposite corner members 204 and 205 and which are disposed between the set of the diagonally opposed corner members 2 and 3 provided with the moving mechanisms and the opposite corner members 204 and 205, are fixed on the opposite corner members 204 and 205 respectively at their ends that are closer thereto.

The rods 10, 11, 12 and 13 are disposed between a set of the diagonally opposed corner members 2 and 3, where the moving mechanisms are provided, and the opposite corner members 204 and 205, respectively. The respective ends of the rods 10, 11, 12 and 13 extending portions toward the opposite corner members 204 and 205 are fixed on these opposite corner members 204 and 205, respectively.

Grooves 204*b*, 204*a*, 205*b* and 205*a*, where collars 15, 20, 27 and 32 provided on the ends of the rods 10, 11, 12 and 13 are engaged, respectively, are formed on the corner members 204 and 205. The collar 15 at the end of the rod 10 is engaged in the groove 204*b*, and the collar 20 at the end of the rod 11 is engaged in the groove 204*a*. The ends of the two rods 10 and 11, being the extending portions toward the corner member 204, are fixed on the corner member 204.

The collar 27 at the end of the rod 12 is engaged in the groove 205*b*, and the collar 32 at the end of the rod 13 is engaged in the groove 205*a*. The ends of the two rods 12 and 13, being the extending portions toward the corner member 205, are fixed on the corner member 205.

The extension tool, therefore, has no transmission mechanism, by which the movement of either one of the two rods extending toward each of the corner members opposite to a set of the diagonally opposed corner members having the moving mechanisms in a direction toward the respective opposite corner members is converted to the movement of the other rod in a direction away from the respective opposite corner members, and by which the movement of either one rod in a direction away from the respective opposite corner members is followed by the movement of the other rod in a direction toward the respective opposite corner members.

The extension tool according to the second embodiment has a structure that is simpler than that of the extension tool of the first embodiment, and the number of parts used can be reduced.

The third embodiment of the extension tool where the adjusting points are reduced to one is shown in FIG. 4, FIG. 5, FIG. 6 and FIG. 7. The same component elements as in the first embodiment are denoted by the same reference numerals and the detailed description is not given here.

Figure 4:
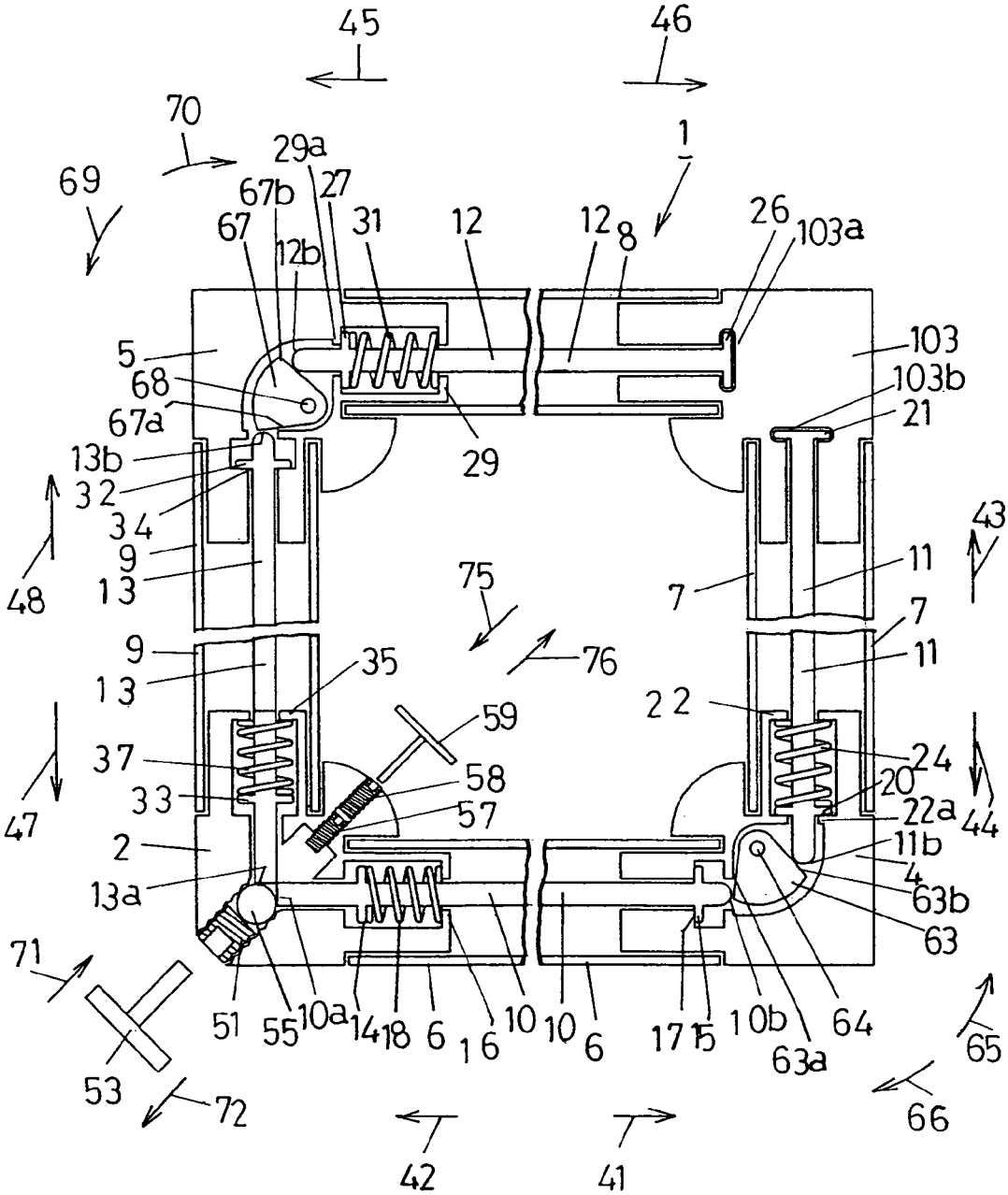
FIG. 4 is a schematic drawing of still another example of the extension tool according to the present invention.
Figure 5:
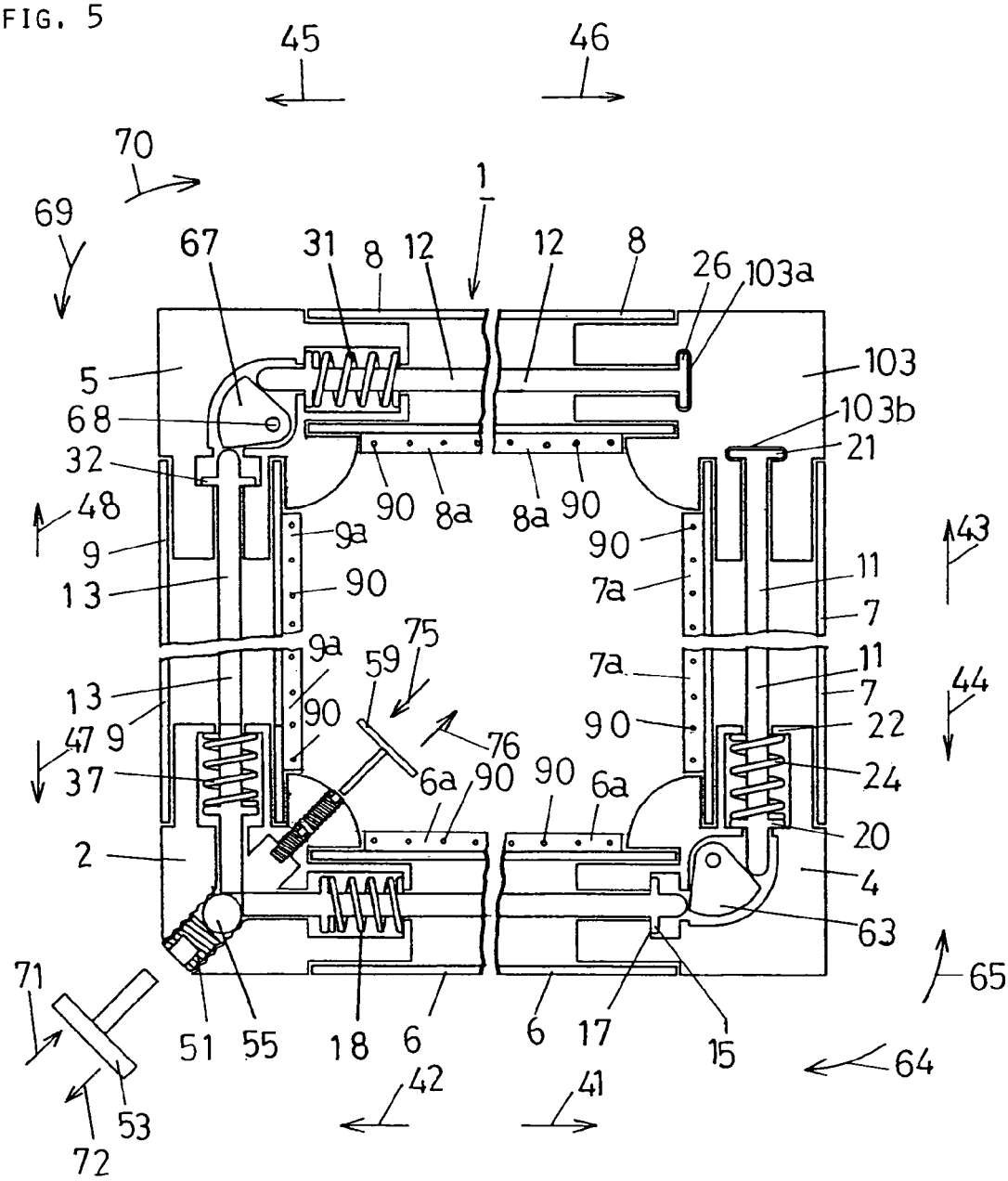
FIG. 5 is a schematic drawing of an example of the extension tool of the present invention provided with anchoring elements inside a frame.
Figure 6:
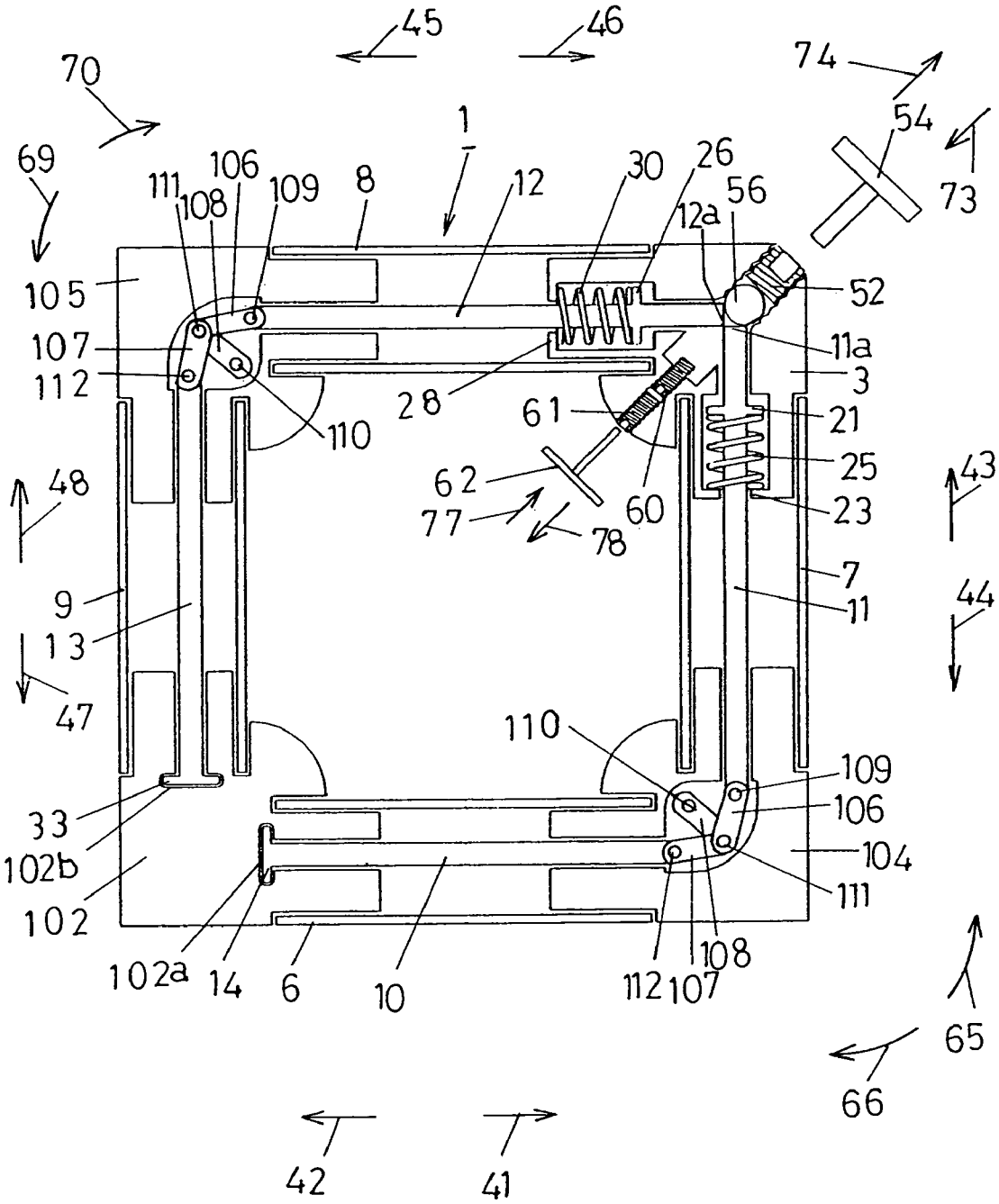
FIG. 6 is a schematic drawing of another example of the extension tool of the invention.
Figure 7:
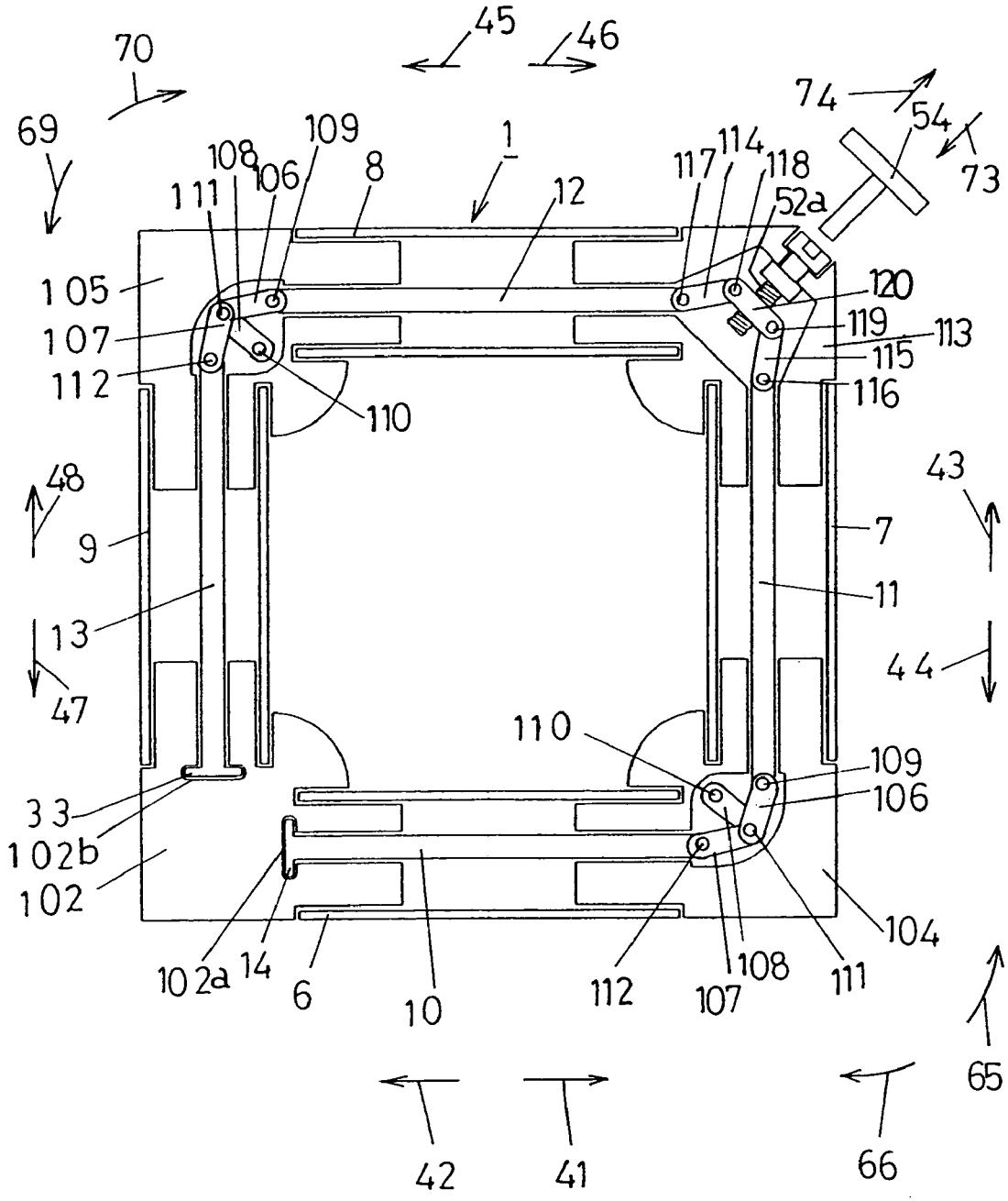
FIG. 7 is a schematic drawing of still another example of the extension tool of the invention.

In the embodiment shown in FIG. 4, FIG. 6 and FIG. 7, unlike the embodiment shown in FIG. 1, the moving mechanism is provided only in one corner member among the four corner members. The moving mechanism is provided on the corner member 2 in FIG. 4, on the corner member 3 in FIG. 6, and on the corner member 113 in FIG. 7.

The moving mechanisms as provided on the corner member 2 shown in FIG. 4 and on the corner member 3 shown in FIG. 6, respectively, are the same as the moving mechanisms provided on the corner members 2 and 3 in the embodiment shown in FIG. 1.

A moving mechanism, which is disposed on the corner member 113 shown in FIG. 7 and which is always in abutment with the ends of the rod 11 and the rod 12 placed between the corner member and the opposite corner members 104 and 105, respectively, moves the rods 11 and 12 toward the opposite corner members 104 and 105, respectively. This moving mechanism comprises a linking mechanism having linking pieces 114, 115, and 120 and pins 116, 117, 118 and 119.

When an insert 52*a* is moved in a direction indicated by an arrow 73 or an arrow 74 by using the T-shaped wrench 54, the rod 11 and the rod 12 are moved in directions indicated by arrows 44 or 43, and by arrows 45 or 46 by the aforementioned linking mechanism.

The T-shaped wrench 54 is inserted into the insert 52*a*, and the insert 52*a* is rotated and is moved forward in a direction indicated by the arrow 73. If it is supposed here that the force required to move the rod 12 in the direction of the arrow 45 is weaker than the force required to move the rod 11 in the direction of the arrow 44, the pushing force caused by the forward movement of the insert 52*a* in the direction 73 is primarily used for moving the rod 12 in the direction of the arrow 45. As a result, the rod 11 is moved in the direction of the arrow 43 by the linking mechanism.

When the force to make the rod 12 move in the direction of the arrow 45 and the force to make the rod 11 move in the direction of the arrow 44 become even, the pushing force caused by the forward movement of the insert 52*a* in the direction 73 is evenly distributed to the force for moving the rod 11 in the arrow direction 44 and to the force for moving the rod 12 in the direction of the arrow 45. Thus, the rod 11 and the rod 12 are pushed by the forces equally and these rods begin to move in the directions indicated by the arrows 44 and 45, respectively.

The T-shaped wrench 54 is inserted into the insert 52*a*, and the insert 52*a* is rotated in reverse direction and is moved backward in the direction of the arrow 74. If it is supposed here that the force for moving the rod 11 in a direction toward the corner member 113 is stronger than the force for moving the rod 12 in a direction toward the corner member 113, the rod 11 is moved in the direction of the arrow 43 as the insert 52*a* is moved backward in the direction of the arrow 74.

When the force for moving the rod 11 in a direction toward the corner member 113 and the force for moving the rod 12 in a direction toward the corner member 113 become even, the rod 11 and the rod 12 begin to move evenly in the directions of the arrow 43 and the arrow 46 respectively as the insert 52*a* is moved backward in the direction of the arrow 74.

The embodiment shown in FIG. 4, FIG. 5, FIG. 6 and FIG. 7 is different from the embodiment shown in FIG. 1 in that the ends of the two rods extending toward the corner member at the position diagonally opposed to the corner member with the moving mechanism are fixed on the corner member.

In the embodiment shown in FIG. 4, each end of the two rods 11 and 12 extending toward the corner member 103 at a position diagonally opposed to the corner member 2 having the moving mechanism are fixed on the corner member 103. In the embodiment shown in this figure, grooves 103*b* and 103*a*, where collars 21 and 26 provided on the ends of the rods 11 and 12 are engaged respectively, are formed on the corner member 103. The collar 21 at the end of the rod 11 is engaged in the groove 103*b*, and the collar 26 at the end of the rod 12 is engaged in the groove 103*a*, and each end of the two rods 11 and 12 is fixed on the corner member 103, respectively.

The extension tool in the embodiment shown in FIG. 4 is provided with a transmission mechanism similar to the one in the embodiment shown in FIG. 1.

Compared with the extension tool of the embodiment shown in FIG. 1, the extension tool of the embodiment shown in FIG. 4 has a simpler structure, and the number of parts needed can be reduced. Thus, it is advantageous because it contributes to a reduction of the manufacturing cost.

The difference of the embodiment shown in FIG. 6 from the embodiments shown in FIG. 4 and FIG. 2 primarily lies in the arrangement of the corner members 4 and 5.

In the corner members 104 and 105 in the embodiment shown in FIG. 6, which correspond to the corner members 4 and 5 in the embodiment shown in FIG. 4, a linking mechanism is adopted instead of the cam mechanism in the case shown in FIG. 4.

The rod 10 or the rod 13 and a linking piece 107 are connected via a pin 112, and the rod 11 or the rod 12 and a linking piece 106 are connected via a pin 109 respectively. A linking mechanism is provided, which comprises these pins 109, 110 and 112 and the linking pieces 106, 107 and 108, and a pin 111, as a linking piece 108 is rotatably mounted on a pin 110, which is projected on the corner members 104 and 105, respectively.

Thus, even when the linking mechanism is adopted instead of the cam mechanism shown in FIG. 4 provided on the corner members 104 and 105 in the embodiment shown in FIG. 6, which correspond to the corner members 4 and 5 in the embodiment of FIG. 4, the transmission mechanism used in the extension tool of the present invention can carry out the operation as explained in the embodiment shown in FIG. 1.

For instance, when the rod 13 is moved in a direction of the arrow 48, the rod 12 is moved in a direction of the arrow 46 by the linking mechanism provided on the corner member 105. That is, the movement of the rod 13, being one of the two rods 13 and 12 extending toward the corner member 105, in a direction toward the corner member 105 is converted to the movement of the other rod 12 in a direction away from the corner member 105.

Also, when the rod 10 is moved in a direction of the arrow 42, the rod 11 is moved in a direction of the arrow 44 by the linking mechanism provided on the corner member 104. That is, the movement of the rod 10, being one of the two rods 11 and 10 extending toward the corner member 104, in a direction away from the corner member 104 is followed by the movement of the other rod 11 in a direction toward the corner member 104.

Similarly, when the rod 13 is moved in a direction of the arrow 47, the rod 12 is moved in a direction of the arrow 45 by the linking mechanism provided on the corner member 105. That is, the movement of one rod 12 of the two rods 12 and 13 extending toward the corner member 105 in a direction away from the corner member 105 is followed by the movement of the other rod 13 in a direction toward the corner member 105.

Also, when the rod 10 is moved in a direction of the arrow 41, the rod 11 is moved in the direction of the arrow 43 by the linking mechanism provided on the corner member 105. That is, by the aforementioned action of the transmission mechanism, the movement of the one rod 10 of the two rods 10 and 11 extending toward the corner member 104 in a direction toward the corner member 104 is converted to the movement of the other rod 11 in a direction away from the corner member 104.

Compared with the extension tool of the embodiments shown in FIG. 4 and FIG. 2, respectively, the extension tool of the embodiment shown in FIG. 6 can reduce the number of the elastic members used.

The structure and the arrangement of the embodiment shown in FIG. 7 are the same as those of the embodiment shown in FIG. 6, as described above, except that the structure of the moving mechanism is different from that shown in FIG. 1, FIG. 4 or FIG. 6.

Compared with the extension tool of the embodiment shown in FIG. 6, the extension tool of the embodiment of FIG. 7 can reduce the number of the elastic members used.

Figure 8:
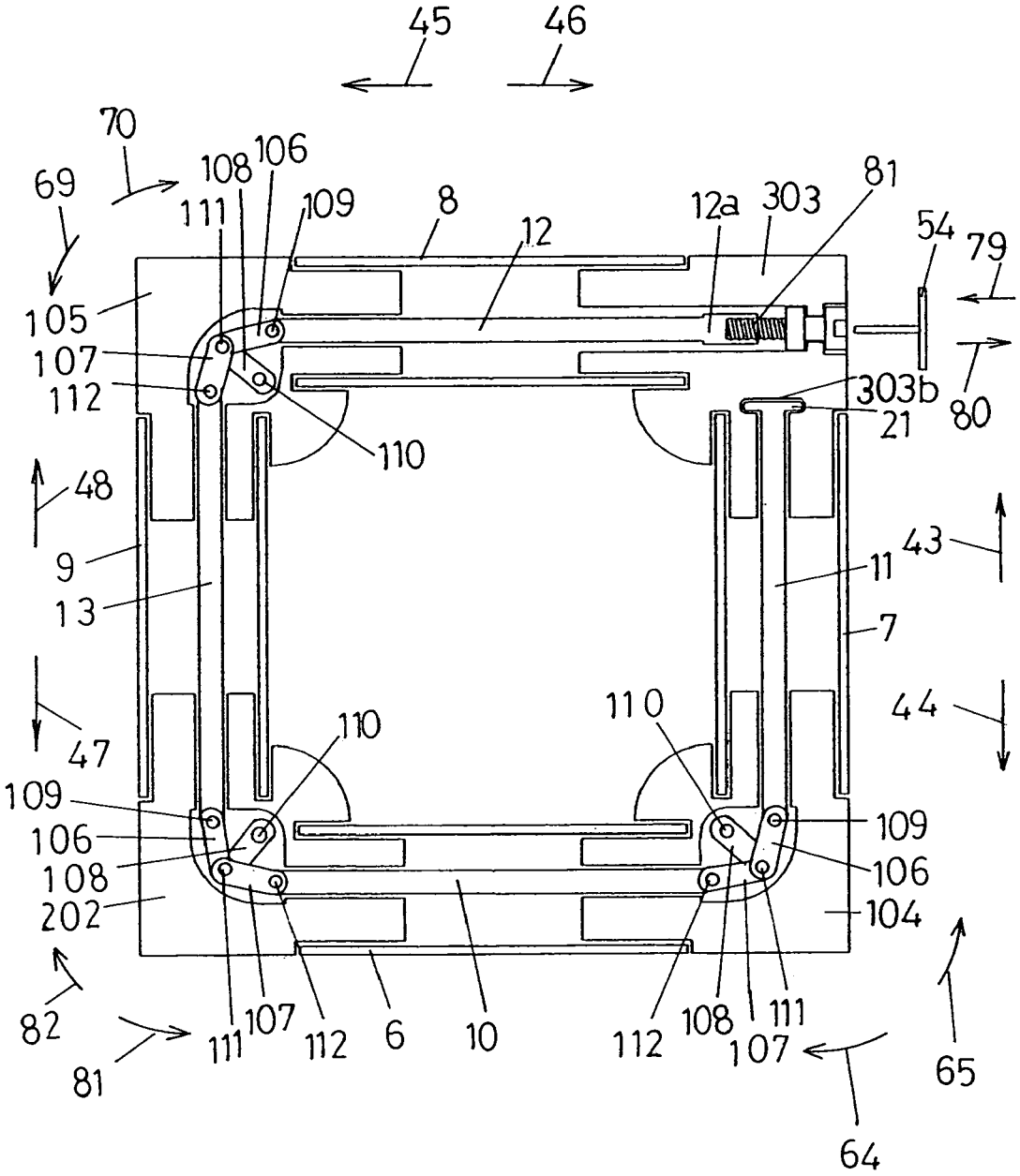
FIG. 8 is a schematic drawing of yet still another example of the extension tool of the invention.

Referring to FIG. 8, a fourth embodiment of the extension tool of the invention will now be described. The same component elements as those of the embodiment shown in FIG. 1 are denoted by the same reference numerals, and the detailed description is not given here.

In this extension tool, a moving mechanism is provided on a corner member 303, which is one of the four corner members. The moving mechanism is always in abutment with an end 12*a* of the rod 12 disposed between the corner member 303 and the corner member 105, which is one of the two opposite corner members 104 and 105, and moves the rod 12 in a direction indicated by the arrow 45 toward the corner member 105. The end of the rod 11, which is disposed between the corner member 303 and the other corner member 105 of the two opposite corner members 104 and 105 is fixedly connected to the corner member 303 where the moving mechanism is provided.

In the corner member 303 provided with the moving mechanism, when the T-shaped wrench 54 is inserted into the insert 81 to rotate it, and the insert 81 is moved forward in a direction indicated by an arrow 79, the rod 12, which is placed between the opposite corner member 105 and the corner member 303, is moved in a direction of the arrow 45 toward the corner member 105. Also, when the insert 81 is rotated in the reverse direction, the insert 81 is moved backward in a direction of an arrow 80, and the rod 12 disposed between the opposite corner member 105 and the corner member 303 is moved in a direction of the arrow 46 away from the corner member 105.

In the extension tool of the embodiment shown in FIG. 8, the linking mechanism provided on each of the corner members 104 and 105 in the embodiment shown in FIG. 6 is provided on each of the corner members 105, 202 and 104, i.e., on each of the corner members other than the corner member 303 where the moving mechanism is provided.

A transmission mechanism is provided on the extension tool of the embodiment shown in FIG. 8. By the action of this transmission mechanism, the movement of one of the two rods extending toward the corner members 105, 202 and 104 in a direction toward the respective corner members 105, 202 and 104 is converted to the movement of the other rod in a direction away from the respective corner members 105, 202 and 104. Also, by the action of this transmission mechanism, the movement of one of the rods in a direction away from each of the corner members 105, 202 and 104 is followed by the movement of the other rod in a direction toward each of the corner members 105, 202 and 104.

Compared with the extension tool of the embodiment shown in FIG. 1, the extension tool of the embodiment in FIG. 8 can reduce the number of the elastic members used.

Referring to FIG. 9, FIG. 10, FIG. 11, FIG. 12, FIG. 13 and FIG. 14, a mechanism to stretch the sheet-shaped material to the extension tool will be described below.

Figure 9:
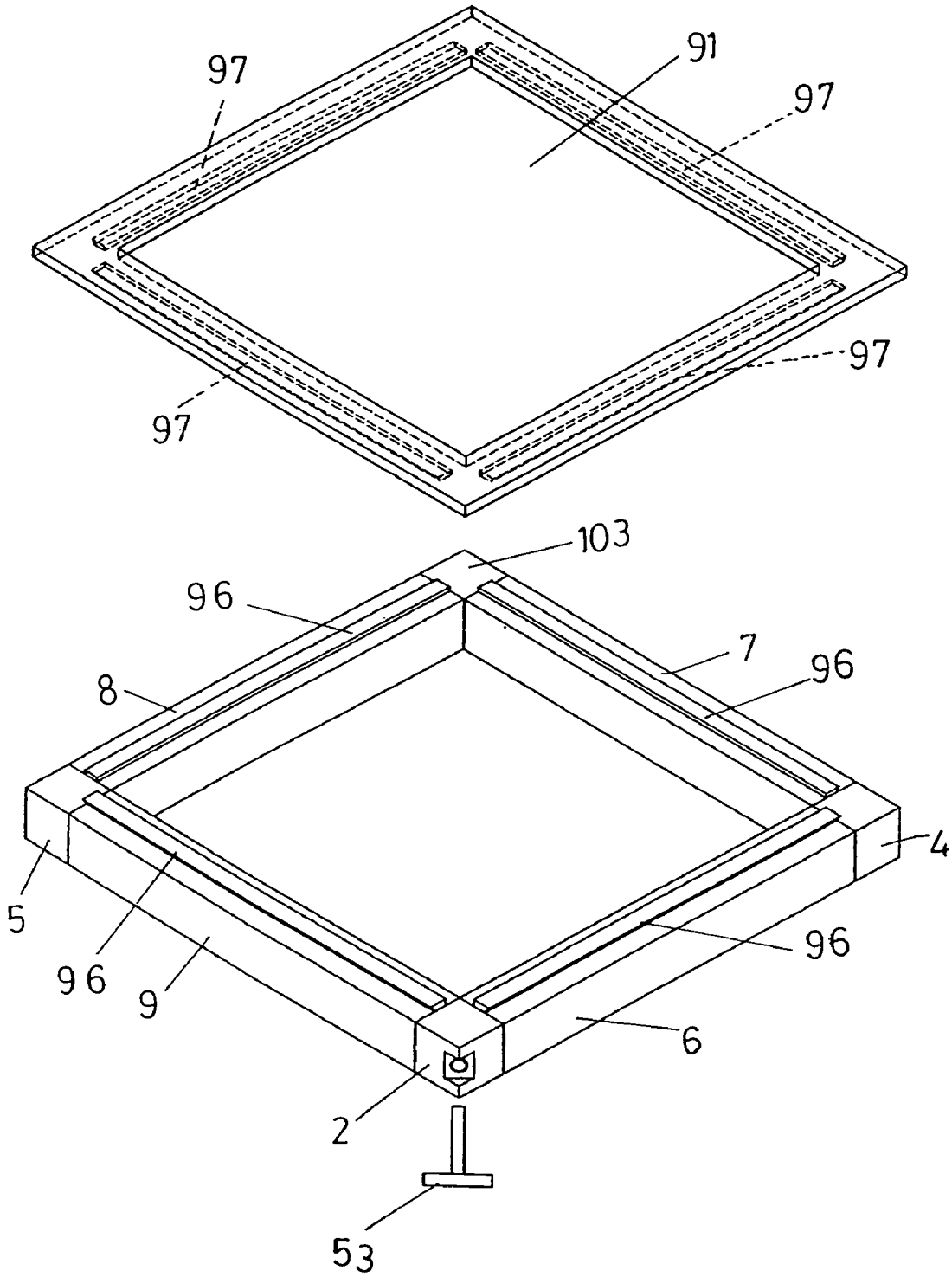
FIG. 9 is a schematic perspective view of the extension tool of the invention where an anchoring element is provided on the upper surface on a frame member.
Figure 10:
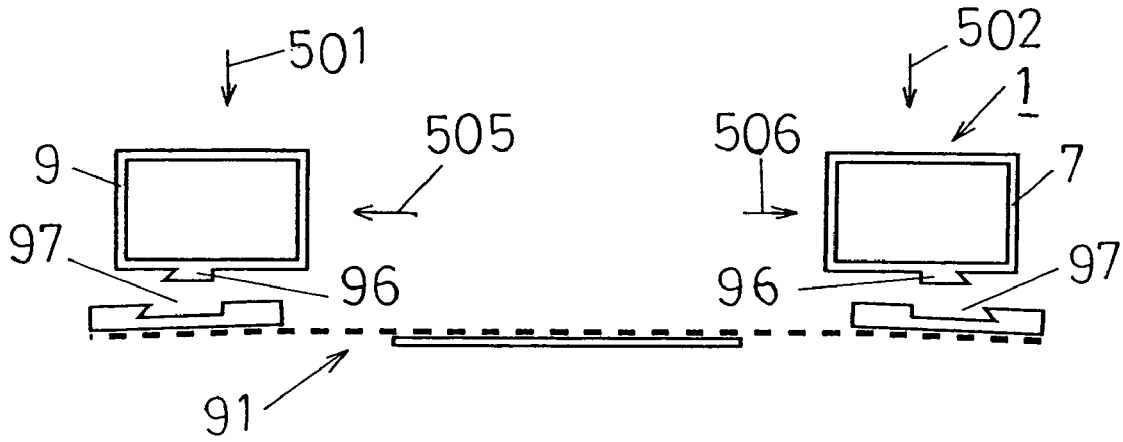
FIG. 10 shows a process when a sheet-shaped material is stretched and its tension adjusted on an extension tool of the invention.
Figure 10:
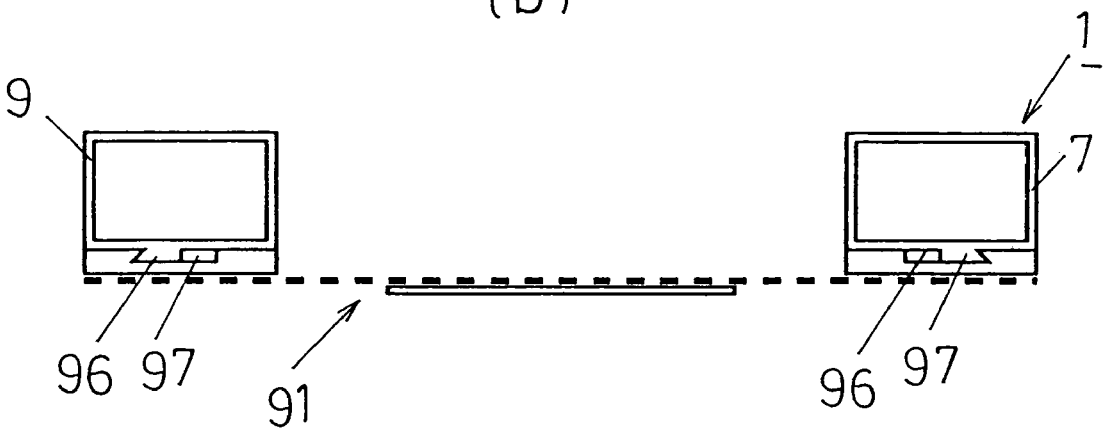

In each of the examples shown in FIG. 9 and FIG. 10, a ridge 96 is provided on the upper side of each of the frame members 6, 7, 8 and 9, and a groove 97 to engage with the ridge 96 is formed on the peripheral edge of the sheet-shaped material 91, which is to be stretched by the extension tool.

As shown in FIG. 10, when the frame members 6, 7, 8 and 9 of the extension tool 1 of the sheet-shaped material are pushed from directions indicated by arrows 501 and 502 and the ridge 96 is pushed into the groove 97, an operation is performed to adjust the extension and the tension in directions of arrows 505 and 506. Then, the sheet-shaped material 91 can be stretched over its entirety by uniform tension as shown in FIG. 10(*b*) and FIG. 11(*b*), respectively.

Figure 11:
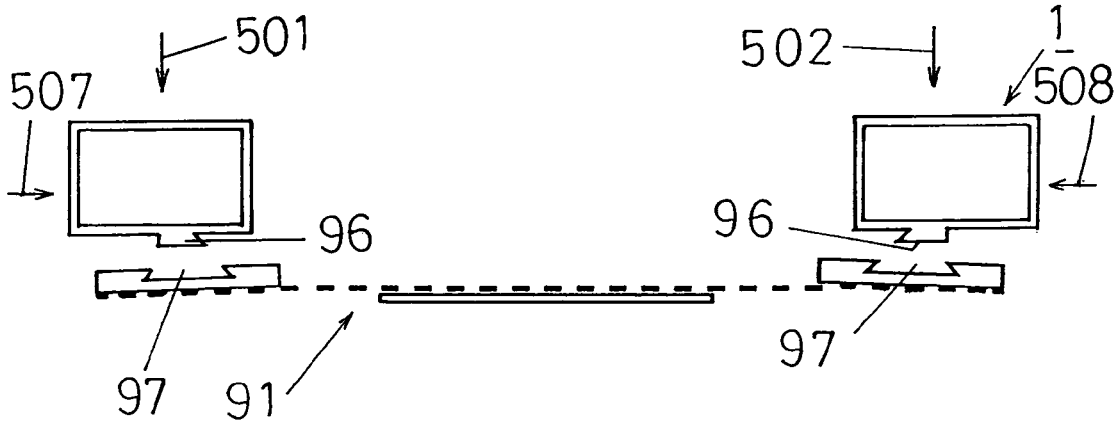
FIG. 11 shows a process when a sheet-shaped material is stretched and its tension adjusted on another extension tool of the invention.
Figure 11:
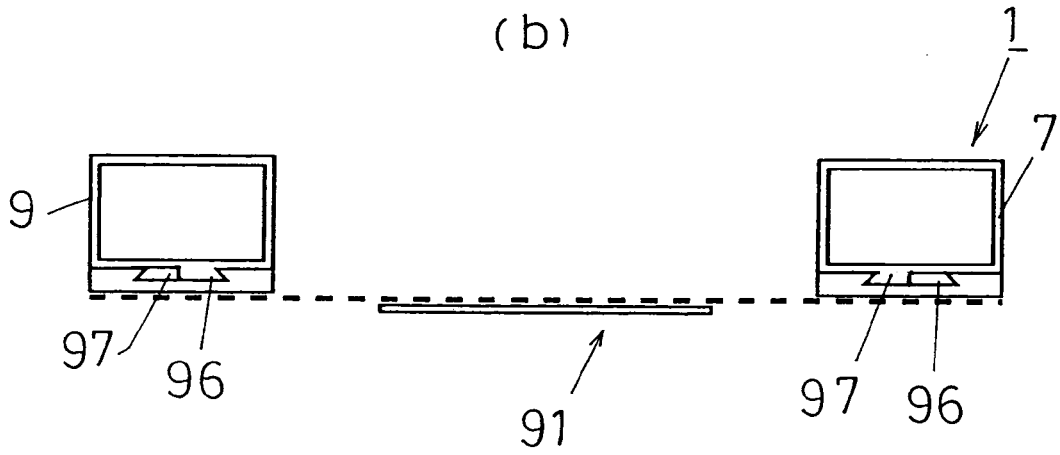

In the arrangement shown in FIG. 10(*a*) and FIG. 10(*b*) and in the arrangement shown in FIG. 11(*a*) and FIG. 11(*b*), the tilting direction of the ridge 96 provided on the upper side of each of the frame members 6, 7, 8 and 9 is different. The ridge is engaged into the groove 97 formed on the peripheral edge of the sheet-shaped material 91 at the outer position in the case of the arrangement shown in FIG. 10(*a*) and FIG. 10(*b*) while it is at the inner position in the arrangement shown in FIG. 11(*a*) and FIG. 11(*b*).

Figure 12:
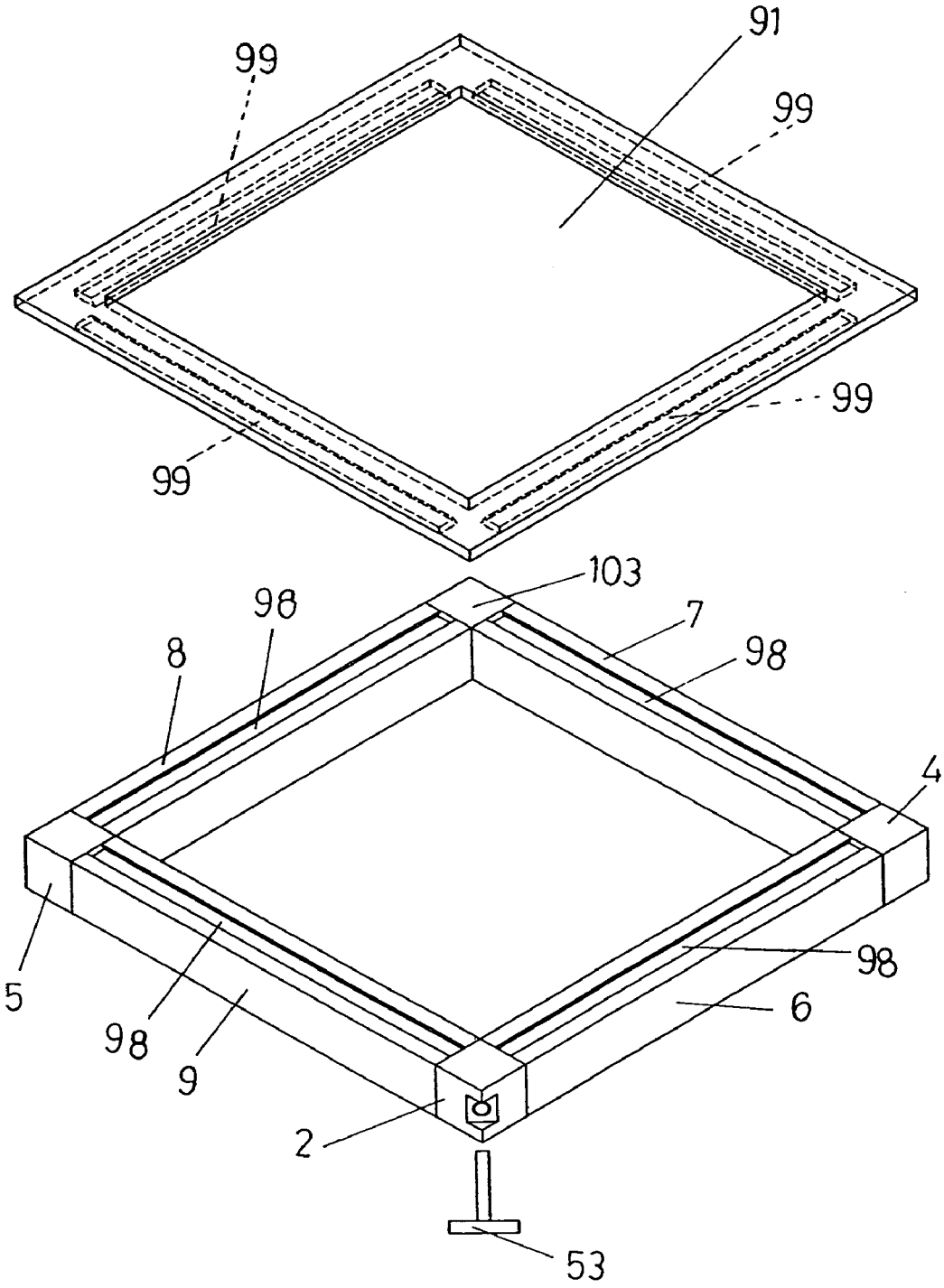
FIG. 12 is a drawing showing another example of the extension tool of the invention provided with an anchoring element on the upper surface of a frame member.
Figure 13:
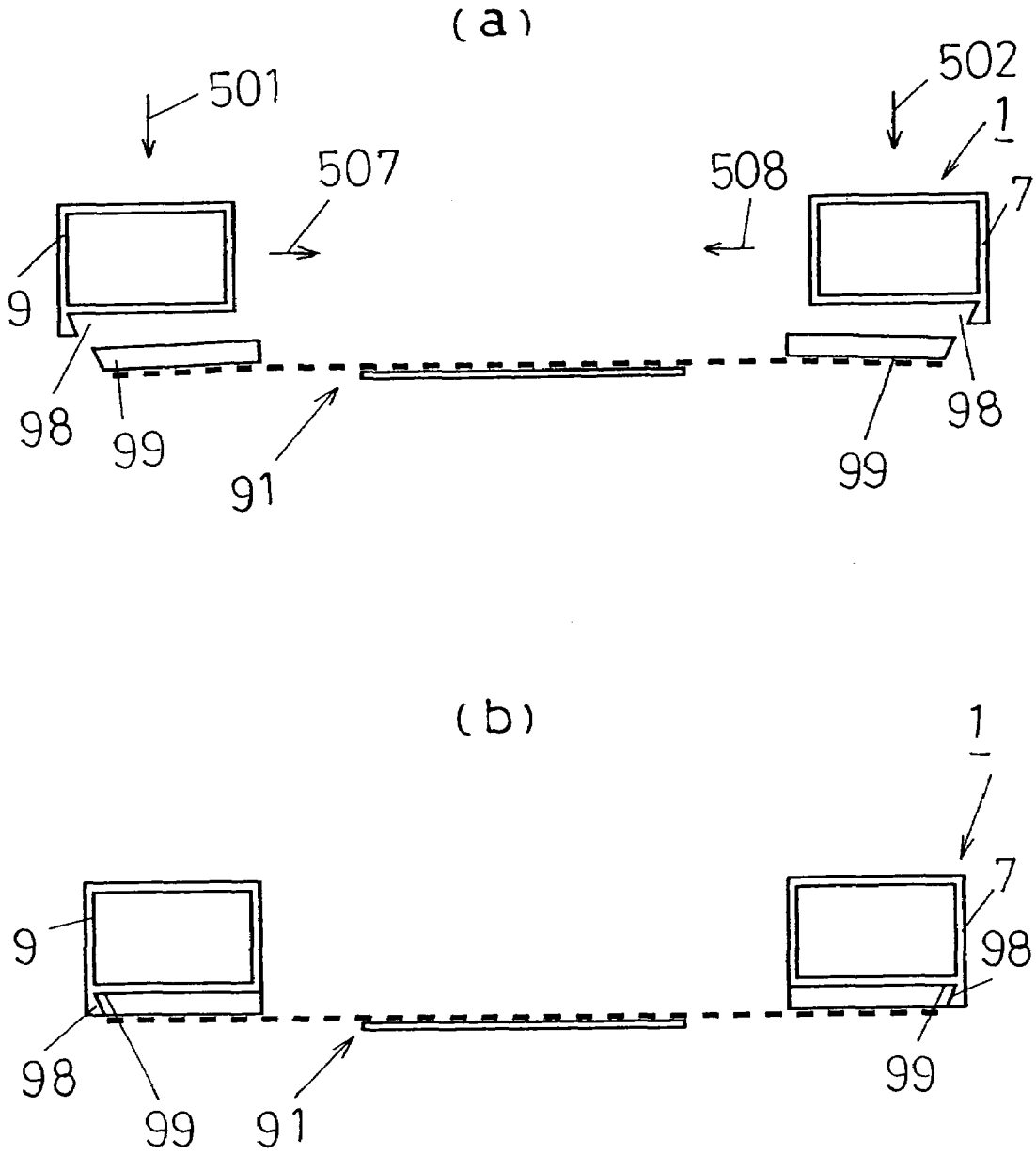
FIG. 13 shows a process when a sheet-shaped material is stretched and adjusted its tension on still another extension tool of the invention.
Figure 14:
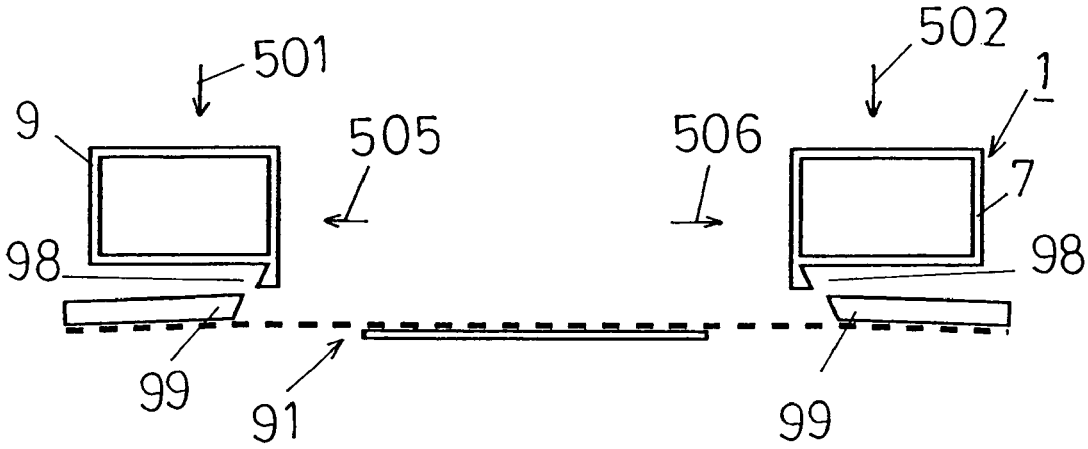
FIG. 14 shows a process when a sheet-shaped material is stretched and its tension adjusted on still another extension tool of the invention.
Figure 14:
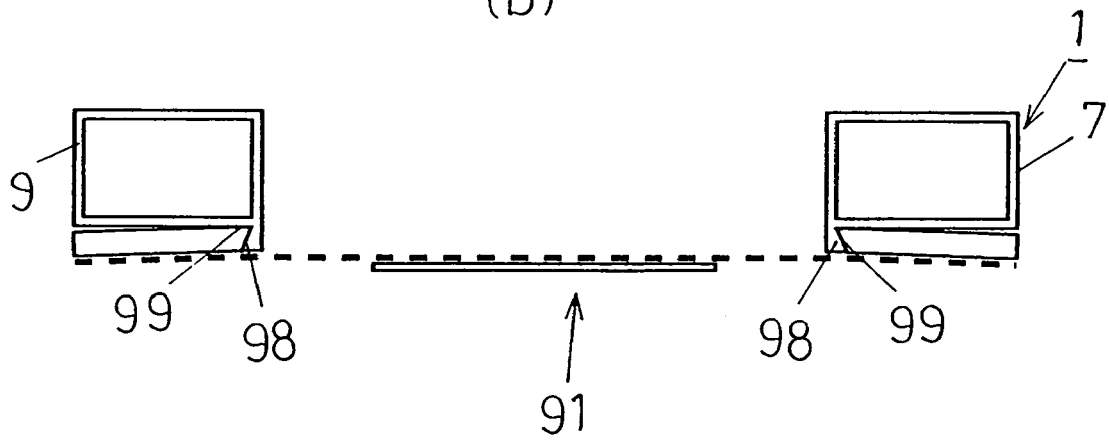
Figure 23:
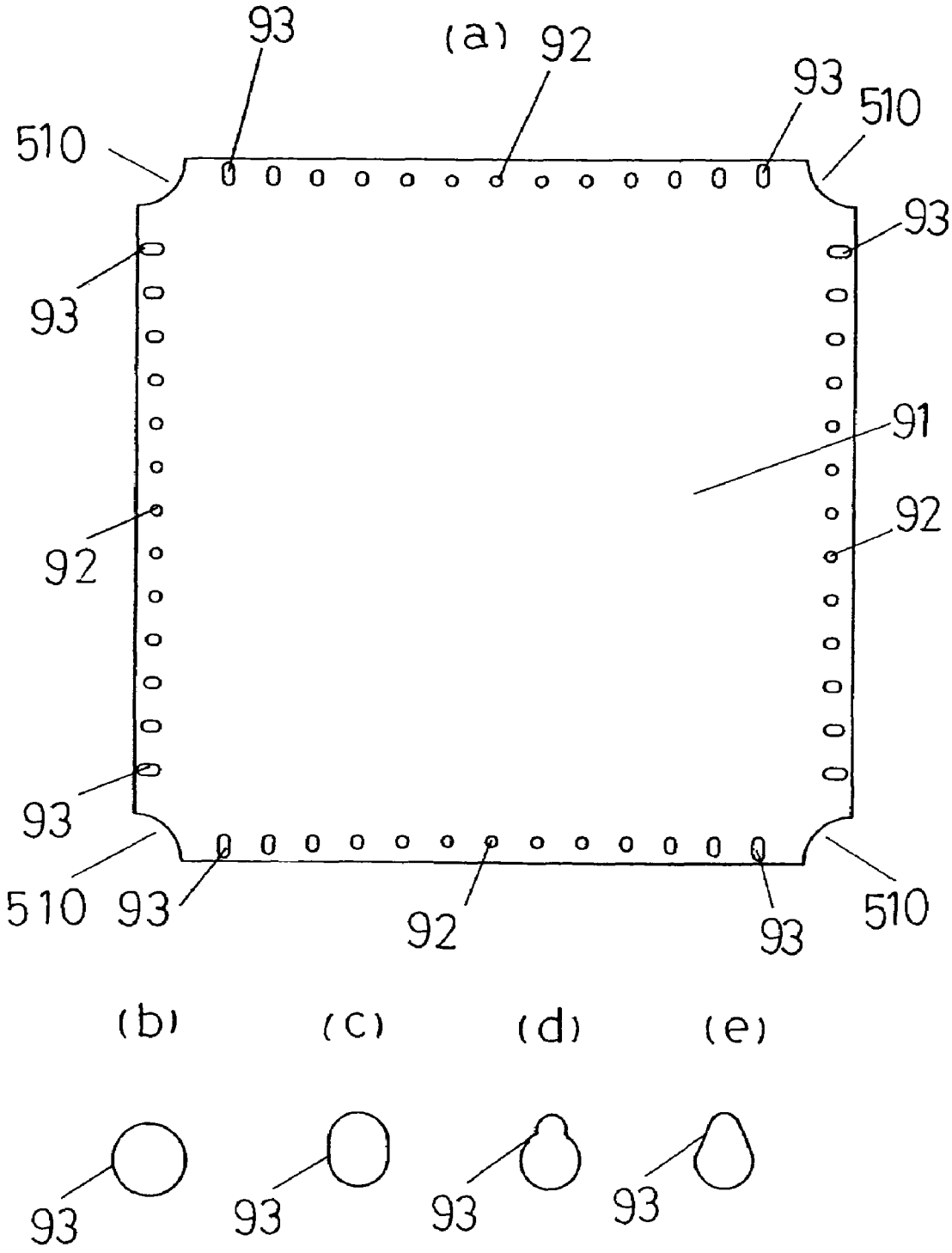
FIG. 23 shows an example of the sheet-shaped material stretched on the extension tool of the present invention.

Each of FIG. 13(*a*) and FIG. 13(*b*), and FIG. 14(*a*) and FIG. 14(*b*) shows a case where the sheet-shaped material 91 stretched on the extension tool 1 for the sheet-shaped material is a metal sheet used in screen printing and where a ridge 99 is provided on the peripheral edge as shown in FIG. 12 and in FIG. 23. In this case, the sheet-shaped material 91 is stretched in a structure in which a groove 98 is engaged with the ridge 99 on the upper side of each of the frame members 6, 7, 8 and 9.

Figure 20:
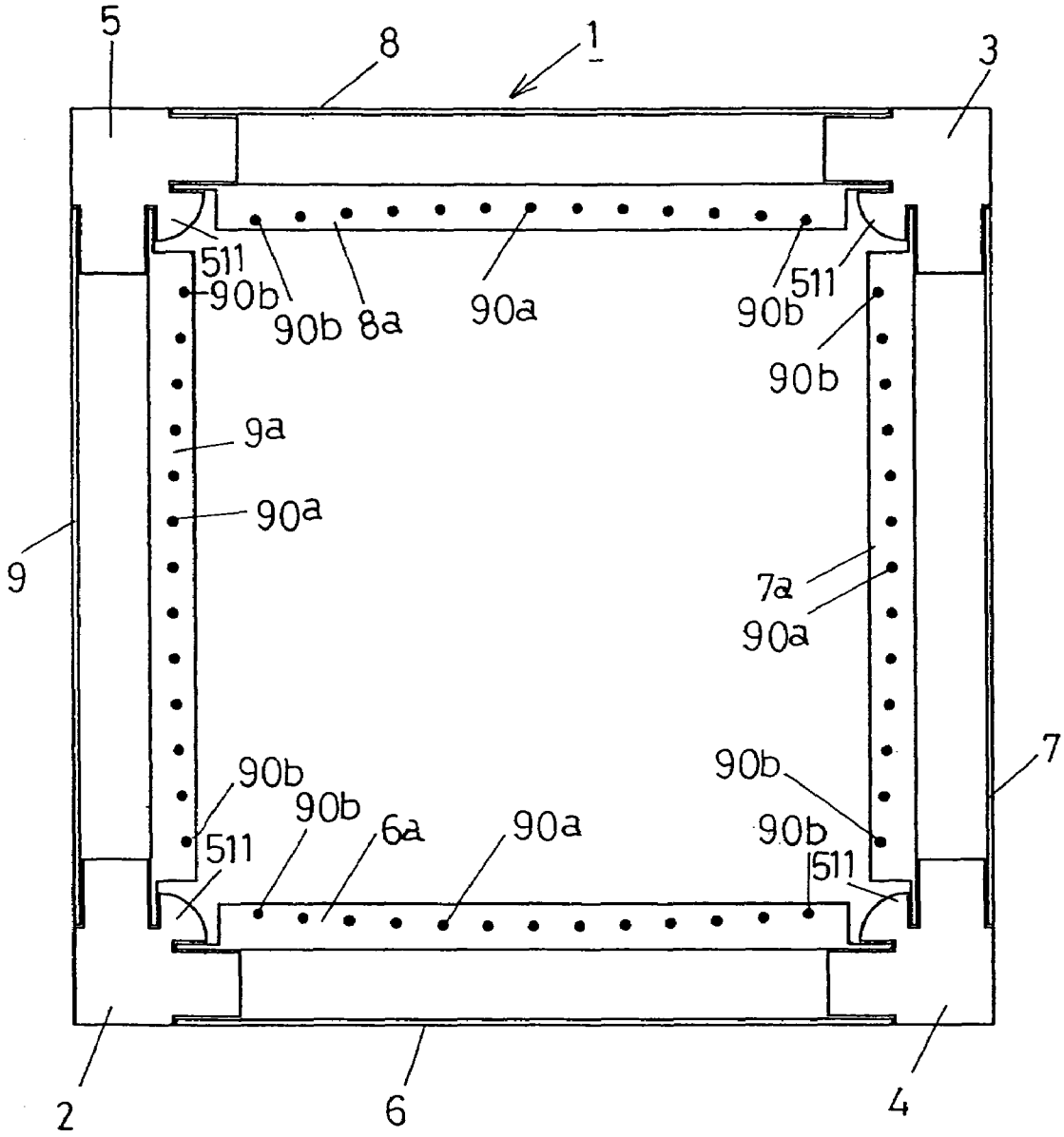
FIG. 20 is a schematic drawing of another example of the extension tool according to the present invention before the sheet-shaped material is stretched.

Each of the frame members 6, 7, 8 and 9 of the extension tool 1 for the sheet-shaped material is pushed from the directions of arrows 501 and 502 so as to engage the ridge 99 into the groove 98 and the operation to adjust the extension and the tension is performed in directions of arrows 507, 508, 505 and 506 as explained in the first embodiment, and the sheet-shaped material 91 can be stretched over its entirety by the uniform tension as shown in FIG. 13(*b*), FIG. 20 and FIG. 14(*b*).

The tilting direction of the groove 97 provided on each of the frame members 6, 7, 8 and 9 is different between the arrangement shown in FIGS. 13(*a*) and (*b*) and the arrangement shown in FIGS. 14(*a*) and (*b*). Accordingly, the ridge 99 provided on the peripheral edge of the sheet-shaped material 91 engages at the outer position in the arrangements shown in FIGS. 13(*a*) and (*b*), while it engages at the inner position in the arrangements shown in FIGS. 14(*a*) and (*b*).

Instead of the arrangement where an anchoring element is provided in each of the frame members 6, 7, 8 and 9, it can be arranged so that an anchoring element where the peripheral edge of the sheet-shaped material is anchored is provided on each of the corner members 2, 3, 4 and 5.

Figure 15:
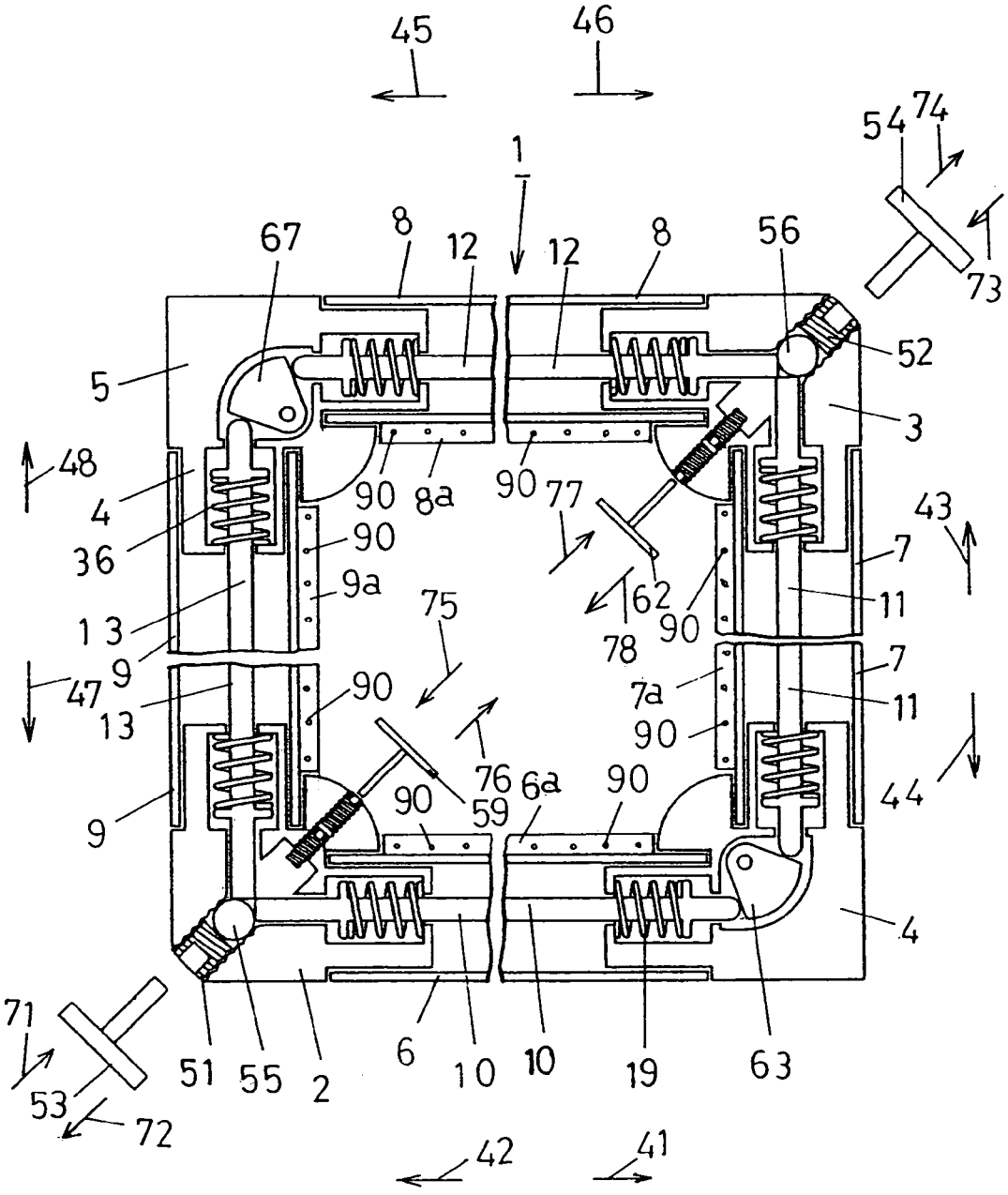
FIG. 15 is a schematic drawing of an example of the extension tool of the present invention provided with anchoring elements inside a frame.
Figure 16:
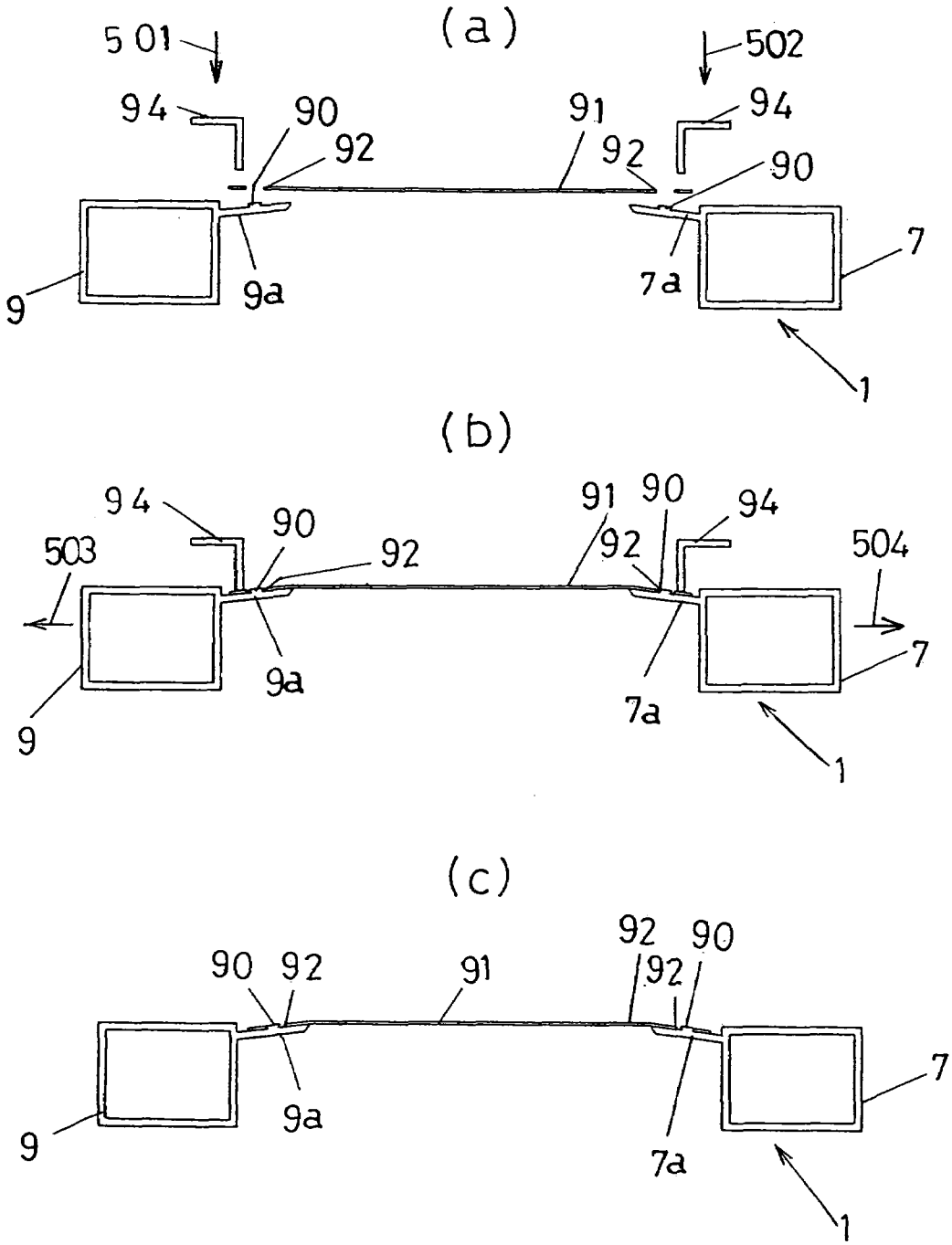
FIG. 16 shows a process for adjusting the tension when the sheet-shaped material is stretched on the extension tool according to the invention where anchoring elements are provided on the inner side of the frame.

With reference to FIG. 15 and FIG. 16, a sixth embodiment of the extension tool for the sheet-shaped material according to the invention will be described. The same component elements as shown in the first embodiment of FIG. 1 are denoted by the same reference numerals, and the detailed description is not given here.

The difference of the sixth embodiment from the first embodiment is that inner pieces 6*a*, 7*a*, 8*a* and 9*a* extend from each of the frame members 6, 7, 8 and 9 of the extension tool 1 of the sheet-shaped material toward an inward direction, and engaging projections 90 are formed on each of the inner pieces 6*a*, 7*a*, 8*a* and 9*a*.

The inner pieces 6*a*, 7*a*, 8*a* and 9*a* stretched in the inward direction from the frame members 6, 7, 8 and 9 of the extension tool 1 for the sheet-shaped material are mounted respectively at such positions that these inner pieces do not protrude from a plane formed by the frame members 6, 7, 8 and 9 as indicated by 7*a* and 9*a* in FIG. 16. In the case shown in FIG. 16, the inner pieces are provided respectively on the inner sides of the frame member 7 and the frame member 9 of the extension tool 1 of the sheet-shaped material from a somewhat lower position thereof to a tilted upward direction. On each of the inner pieces 7*a* and 9*a*, engaging projections 90 are formed, each of which has an end surface at the same position as the plane where each of the frame members 6, 7, 8 and 9 is formed.

As shown in FIG. 16(*a*), an engaging hole 92 on the sheet-shaped material 91 is engaged with each of the engaging projections 90 protruded on each of the inner pieces 6*a* and 9*a*, respectively, and the engaged projections and holes are pressed in directions of arrows 501 and 502, respectively, by means of a fitting device 94. Then, the tension is adjusted to stretch in directions of arrows 503 and 504 as shown in FIG. 16(*b*).

Because the inner pieces 7*a* and 9*a* are disposed so as to be tilted upward and inward from the extension tool 1 of the sheet-shaped material, the sheet-shaped material 91 is supported by the edge of the upper end of each of the inner pieces 7*a* and 9*a* and is stretched in the horizontal state as shown in FIG. 16(*c*). In this case, as shown in FIG. 16(*c*), it is arranged so that an upper end of each of the engaging projections 90 does not protrude upwardly above the plane where the sheet-shaped material 91 is stretched in the horizontal state. As a result, the plane formed by the sheet-shaped material at the time of printing is always shaped as a single flat plane.

FIG. 17, FIG. 18, FIG. 19, FIG. 20 and FIG. 21 show examples where a metal sheet is stretched on the extension tool 1 shown in the sixth embodiment. FIG. 23 shows an example of a metal sheet.

In a metal sheet 91, each of four corners is cut off so as to have a configuration that is curved in an inward direction. This cutoff portion 510 is effective to prevent a case where the folded portions may be piled on each other when the four corners of the metal sheet 91 are folded back.

Also, on the inner side of each of the four corner members 2, 3, 4 and 5 on the extension tool 1 of the sheet-shaped material of the present invention, a protruding piece 511 is provided with a shape that matches the shape of the cutoff portion 510.

The protruding piece 511 is effective to reduce the risk of an injury to the hand when an operator stretches the sheet-shaped material 91 on the extension tool 1.

The inner pieces 6*a*, 7*a*, 8*a* and 9*a* are disposed so as to extend inward at the inner side of each of the frame members 6, 7, 8 and 9 of the extension tool 1 of the sheet-shaped material, and the engaging projections 90 protrude from each of the inner pieces 6*a*, 7*a*, 8*a* and 9*a*.

Figure 17:
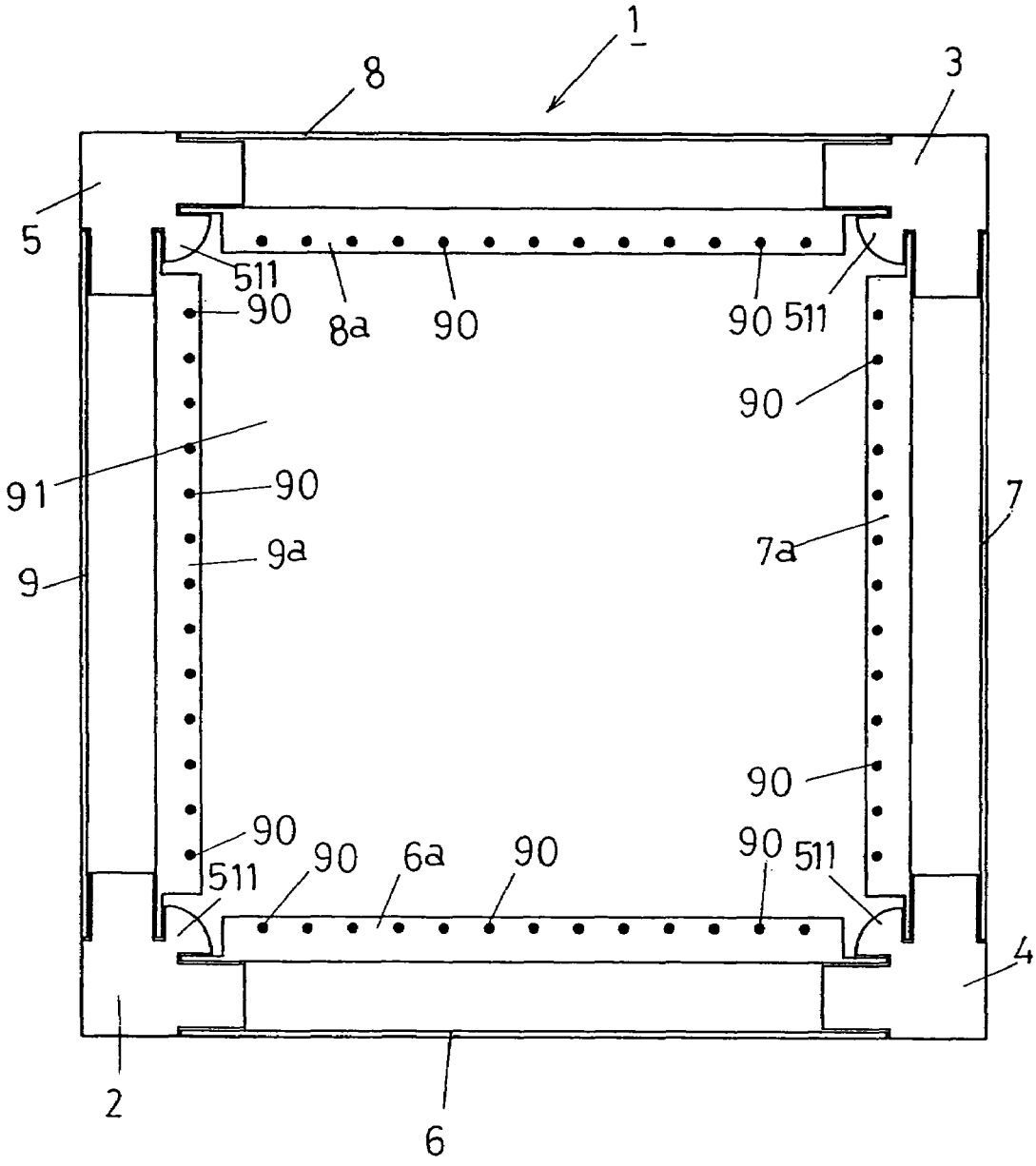
FIG. 17 is a schematic drawing of an example of the extension tool according to the present invention before the sheet-shaped material is stretched.

These engaging projections 90 are designed in a linear arrangement as shown in FIG. 17 or in a convex curved form arrangement in the outward direction from the extension tool 1 as shown in FIG. 20.

In a case where the engaging projections 90 are arranged so that at least their outer edges are aligned as shown in FIG. 17, it is desirable that the engaging holes 92 and 93, each formed at the peripheral edge of the sheet-shaped material 91, are arranged so that at least the positions of the outer edges thereof are forming a convex curved form in the inward direction of the extension tool 1 as shown in FIG. 23(*a*).

Specifically, as shown in FIG. 17, the engaging projections 90 are arranged so that at least the positions of the outer edges of the projections are aligned in a straight line, which is orthogonal to a straight line drawn from the center of the extension tool 1 of the sheet-shaped material to each of the frame members 6, 7, 8 and 9.

On the other hand, the engaging holes 92 and 93 provided on the peripheral edge of the sheet-shaped material 91 are arranged so that the positions of the outer edges of the engaging holes 93 disposed on the outer side of each of the inner pieces 6*a*, 7*a*, 8*a* and 9*a* are located at more outer positions, and the outer edges of the engaging holes 92 disposed at the positions closer to the center on each of the inner pieces 7*a*, 87*a*, 8*a* and 9*a* are located at more inner positions as shown in FIG. 23(*a*). In this way, the engaging holes 92 and 93 are arranged so that at least the positions of their outer edges form an arc shape which is curved in an inward convex toward the inside of the extension tool 1.

Figure 18:
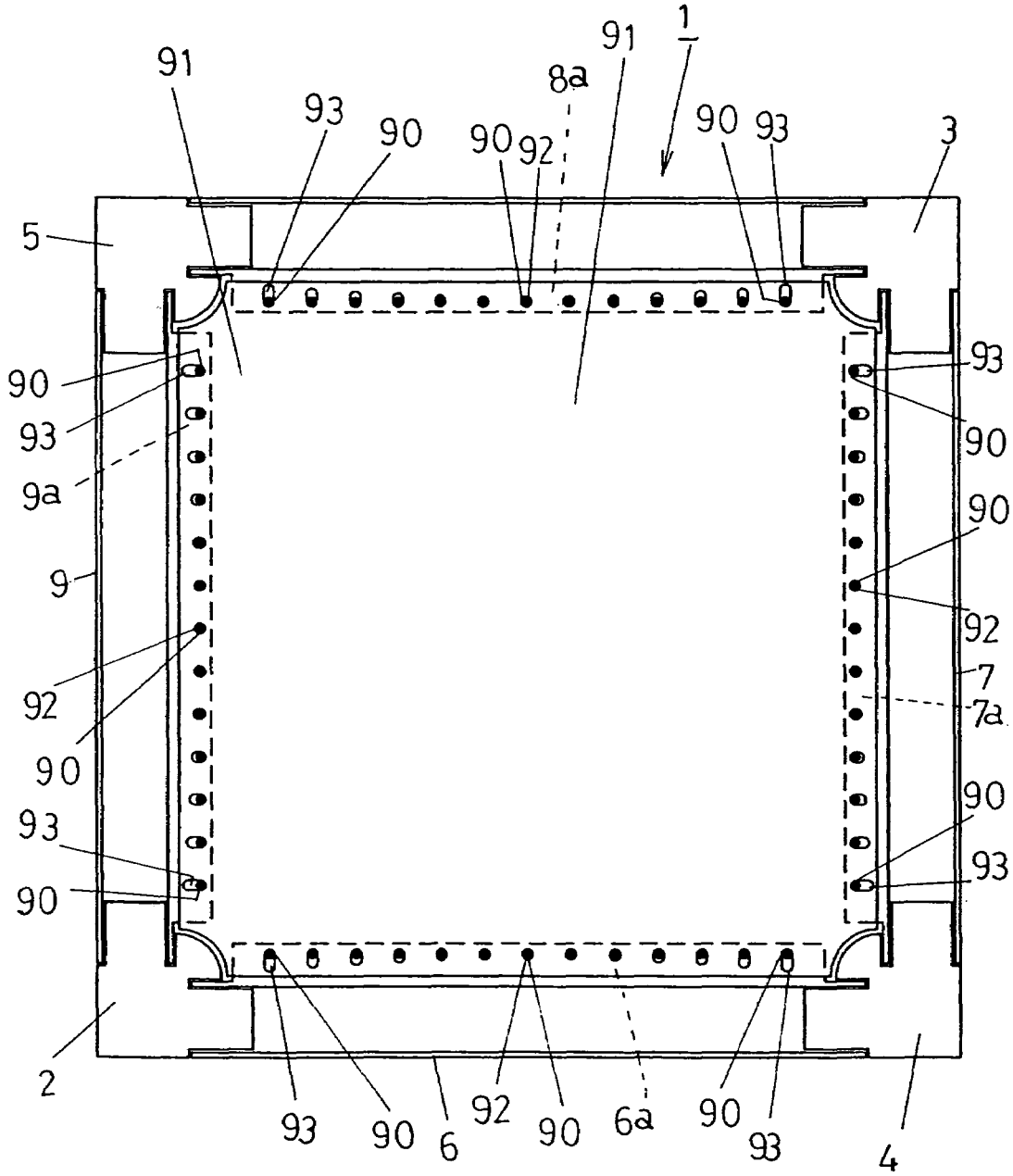
FIG. 18 is a schematic drawing to show when the sheet-shaped material is provisionally stretched on the extension tool shown in FIG. 17.

Here, when the sheet-shaped material 91 shown in FIG. 23(*a*) is provisionally stretched on the extension tool 1 shown in FIG. 17, the relation of the engaging projections 90 with the engaging holes 92 and 93 is as shown in FIG. 18.

Figure 19:
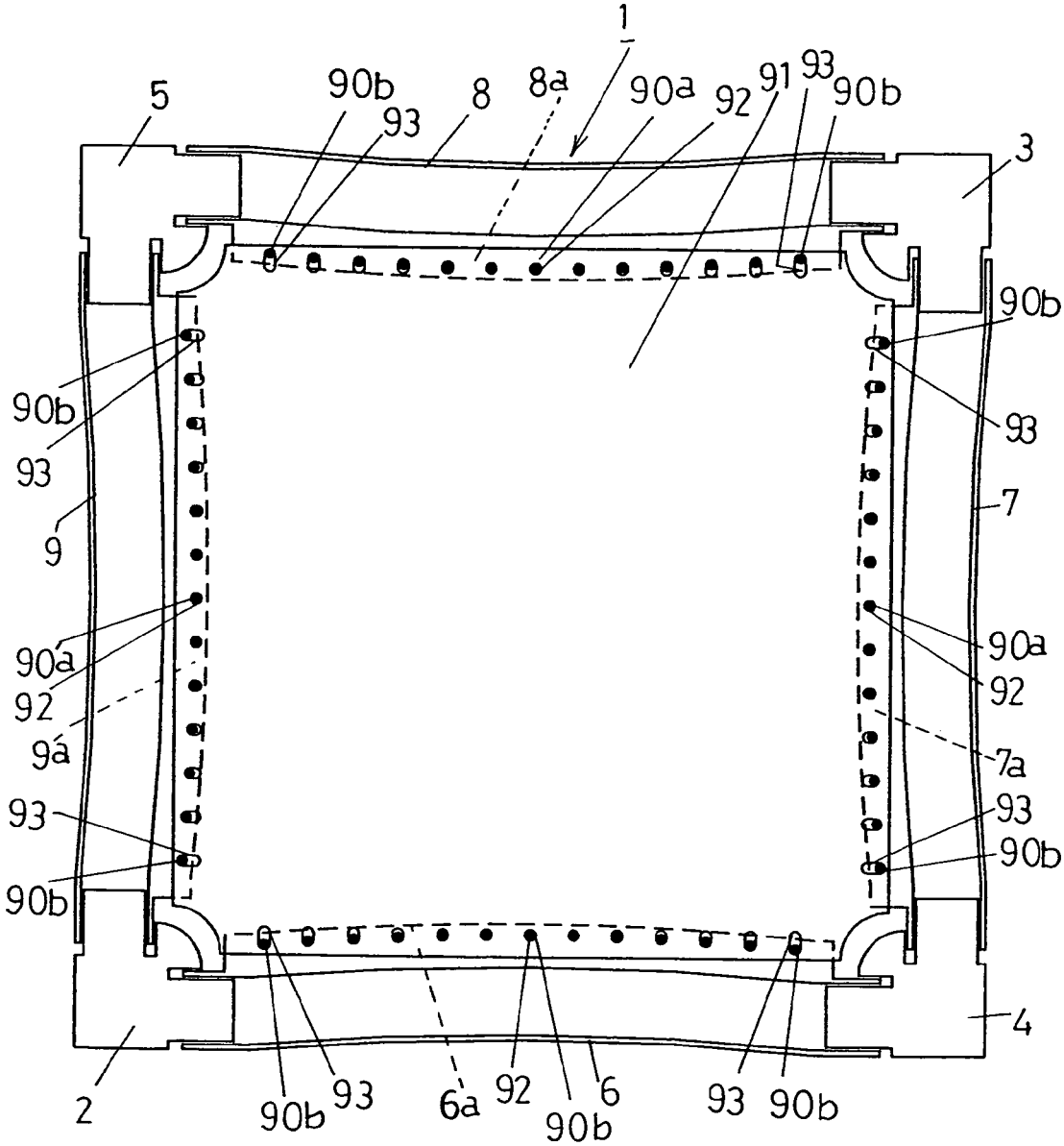
FIG. 19 is a schematic drawing showing where the sheet-shaped material is stretched by adjusting the tension.

Then, if the operation to adjust the stretching and the tension is performed as explained in the first embodiment, the relation of the engaging projections 90 with the engaging holes 92 and 93 is as shown in FIG. 19, and the sheet-shaped material 91 can be stretched over its entirety by the uniform tension.

In order that at least the positions of the outer edges of the engaging holes 92 and 93 disposed on the peripheral edge of the sheet-shaped material 91 form an arc shape which is curved in an inward convex toward the inside of the extension tool 1, each of the engaging holes 93 positioned on the outer side of the inner piece 6*a* may be designed in an elliptical shape or in an elliptical shape formed by two semicircles and two straight lines as shown in FIGS. 23(*a*) and (*c*).

In addition, the engaging hole 93 disposed on the outer side of the inner piece 6*a* may be designed as a circle with full roundness having a diameter that is larger than that of the engaging hole 92 disposed on the inner side closer to the center of the inner piece 6*a*, as shown in FIG. 23(*b*). Also, the engaging hole may be designed in the form of the so-called snowman with a circle having a smaller diameter placed on a circle with the larger diameter as shown in FIG. 23(*d*) so that the circle with the smaller diameter is directed to the outer peripheral edge of the sheet-shaped material 91.

Further, the engaging hole may be designed in the form of a tear drop with a tapered shape as shown in FIG. 23(*e*) so that the tapered end is directed to the outer peripheral edge of the sheet-shaped material 91.

Figure 24:
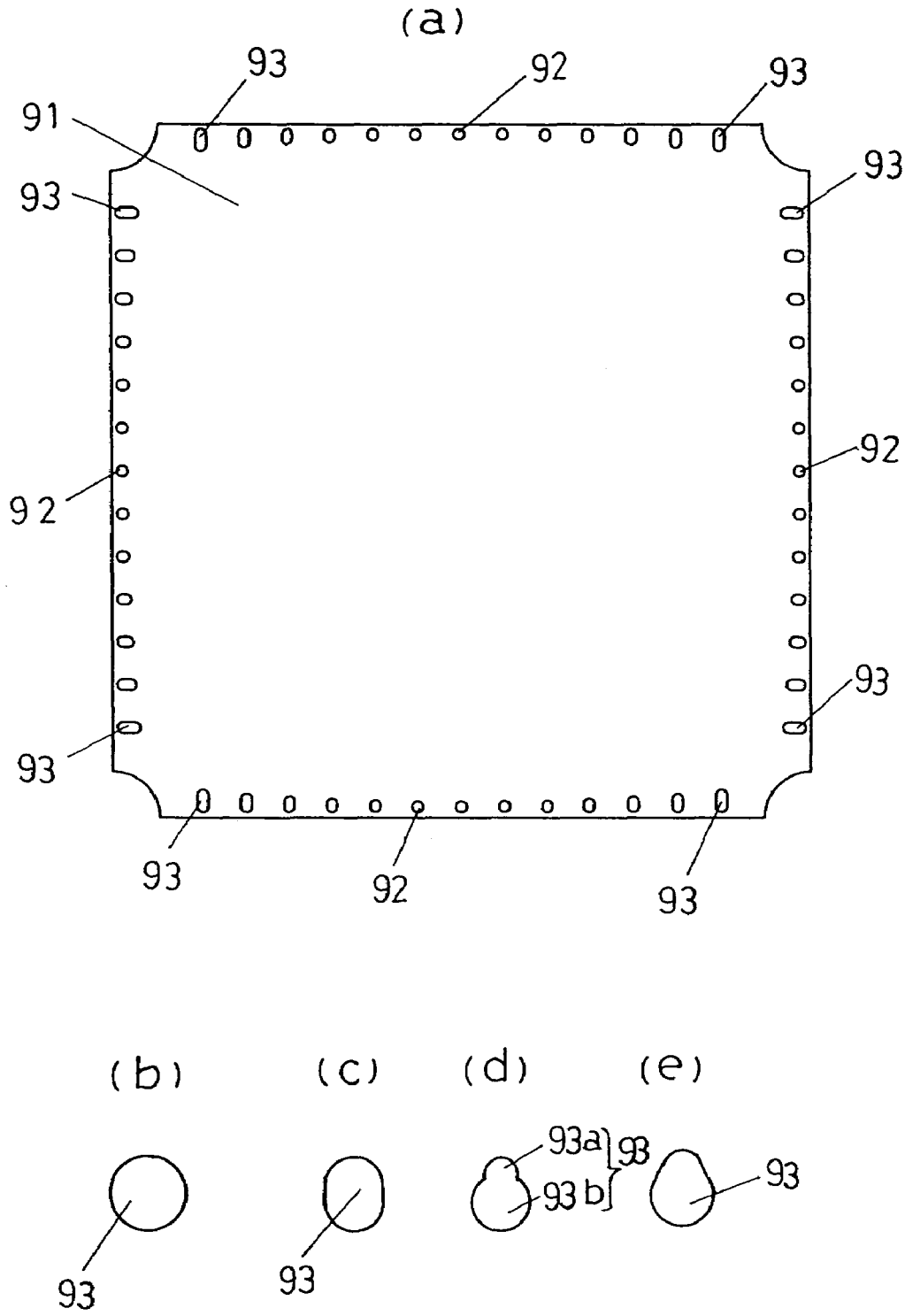
FIG. 24 shows another example of the sheet-shaped material stretched on the extension tool of the present invention.

In a case where the engaging projections 90 are disposed forming an arc shape which is curved in an outward convex toward the outer side of the extension tool 1, as shown in FIG. 20, it is desirable that the engaging holes 92 and 93 disposed on the peripheral edge of the sheet-shaped material 91 are arranged with the positions of their outer edges aligned in a line and with the positions of their inner edges forming an arc shape which is curved in an outward convex toward the outer side of the extension tool 1, as shown in FIG. 24(*a*).

Specifically, as shown in FIG. 20, the engaging projections 90 are disposed in the arc forming arrangement curved in the outward convex toward the outer side of the extension tool 1.

On the other hand, the engaging holes 92 and 93 disposed on the peripheral edge of the sheet-shaped material 91 are so designed that the positions of the outer edges align in a straight line, which is orthogonal to a straight line drawn from the center of the extension tool 1 of the sheet-shaped material to each of the frame members 6, 7, 8 and 9.

The positions of the inner edges of the engaging holes 93 disposed on the outer sides of the inner pieces 6*a*, 7*a*, 8*a* and 9*a* are arranged at more inner positions, and positions of the inner edges of the engaging holes 92 disposed closer to the center of the inner pieces 6*a*, 7*a*, 8*a* and 9*a* are arranged at more outer positions. In this way, the engaging holes 92 and 93 are arranged so that at least the positions of their inner edges form an arc shape which is curved in an outward convex toward the outer side of the extension tool 1.

Figure 21:
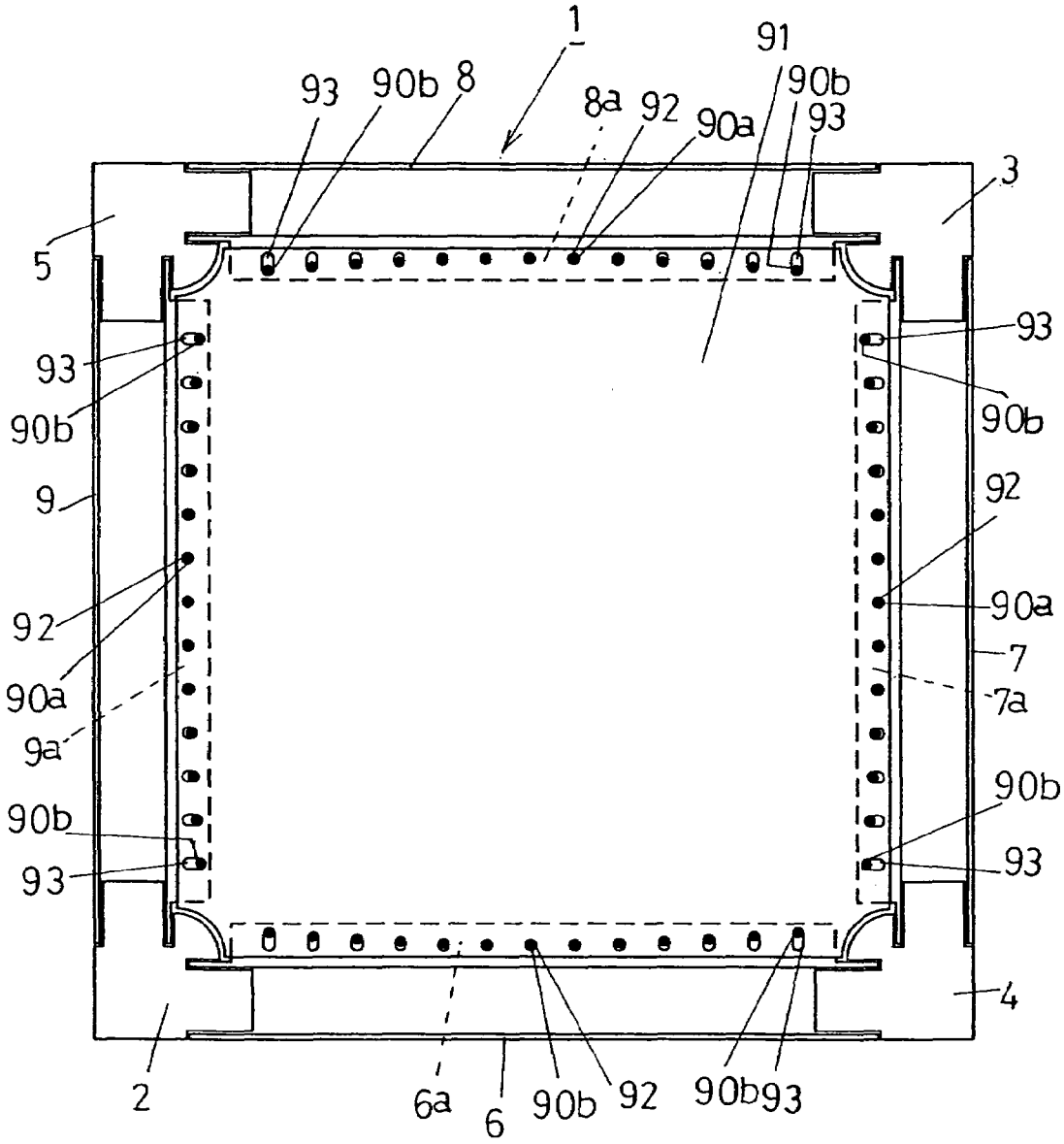
FIG. 21 is a plan view showing when the sheet-shaped material is provisionally stretched on the extension tool shown in FIG. 20.
Figure 22:
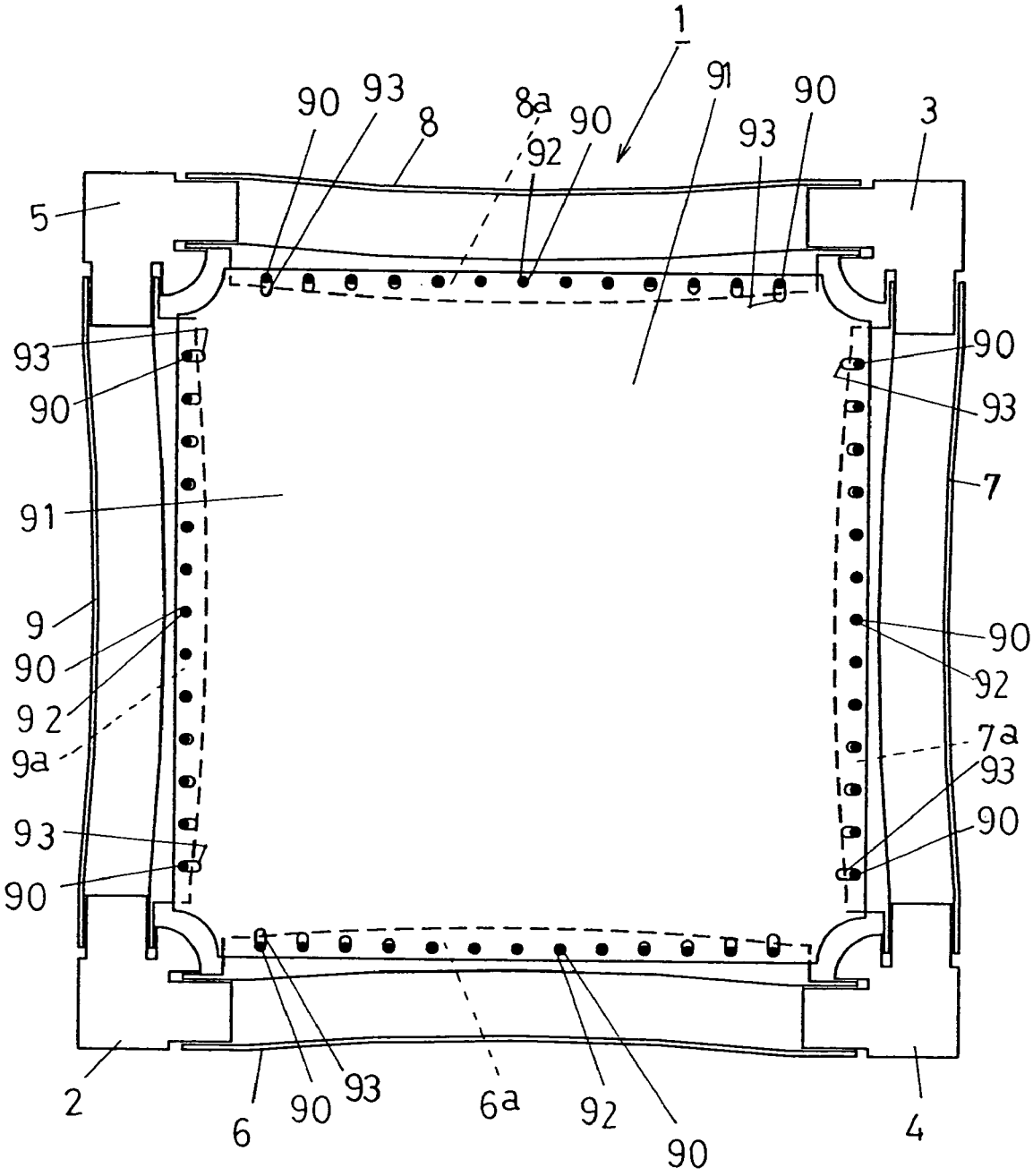
FIG. 22 is a schematic drawing showing where the sheet-shaped material is stretched by adjusting the tension after the condition shown in FIG. 21.

When the sheet-shaped material 91 shown in FIG. 24(*a*) is provisionally stretched on the extension tool 1 shown in FIG. 20, the relation of the engaging projections 90 with the engaging holes 92 and 93 is as shown in FIG. 21.

Then, if the operation to adjust the stretching and the tension is performed as explained in the first embodiment, the relation of the engaging projections 90 with the engaging holes 92 and 93 is as shown in FIG. 19, and the sheet-shaped material 91 can be stretched over its entirety by the uniform tension.

In order that the engaging holes 92 and 93 disposed on the peripheral edge of the sheet-shaped material 91 are so designed that positions of the outer edges are aligned in a linear arrangement and positions of the inner edges form an arc shape which is curved in the outward convex toward the outer side of the extension tool 1, as shown in FIG. 24(*a*), the engaging holes 93 disposed on the outer side of the inner piece 6*a* may be designed in an elliptical shape or in an elliptical shape formed by two semicircles and two straight lines as shown in FIGS. 23(*a*) and (*c*).

In addition, the engaging hole 93 as disposed on the outer side of the inner piece 6*a* may be designed as a circle with full roundness having a diameter that is larger than that of the engaging hole 92 disposed on the inner side closer to the center of the inner piece 6*a*, as shown in FIG. 24(*b*). Also, the engaging hole may be designed in the form of the so-called snowman with a circle having a smaller diameter 93*a* placed on a circle with the larger diameter 93*b* as shown in FIG. 24(*d*) so that the circle with the smaller diameter 93*a* is directed to the outer peripheral edge of the sheet-shaped material 91.

Further, as shown in FIG. 23(*e*), the engaging hole may be designed in the form of a tear drop with the tapered shape so that the tapered end is directed to the outer peripheral edge of the sheet-shaped material 91.

It is desirable that the inner pieces 6*a*, 7*a*, 8*a* and 9*a* stretched respectively from the frame members 6, 7, 8 and 9 of the extension tool 1 of the sheet-shaped material are disposed so as to be tilted inward to and upward from the extension tool 1 of the sheet-shaped material, as described below.

Figure 25:
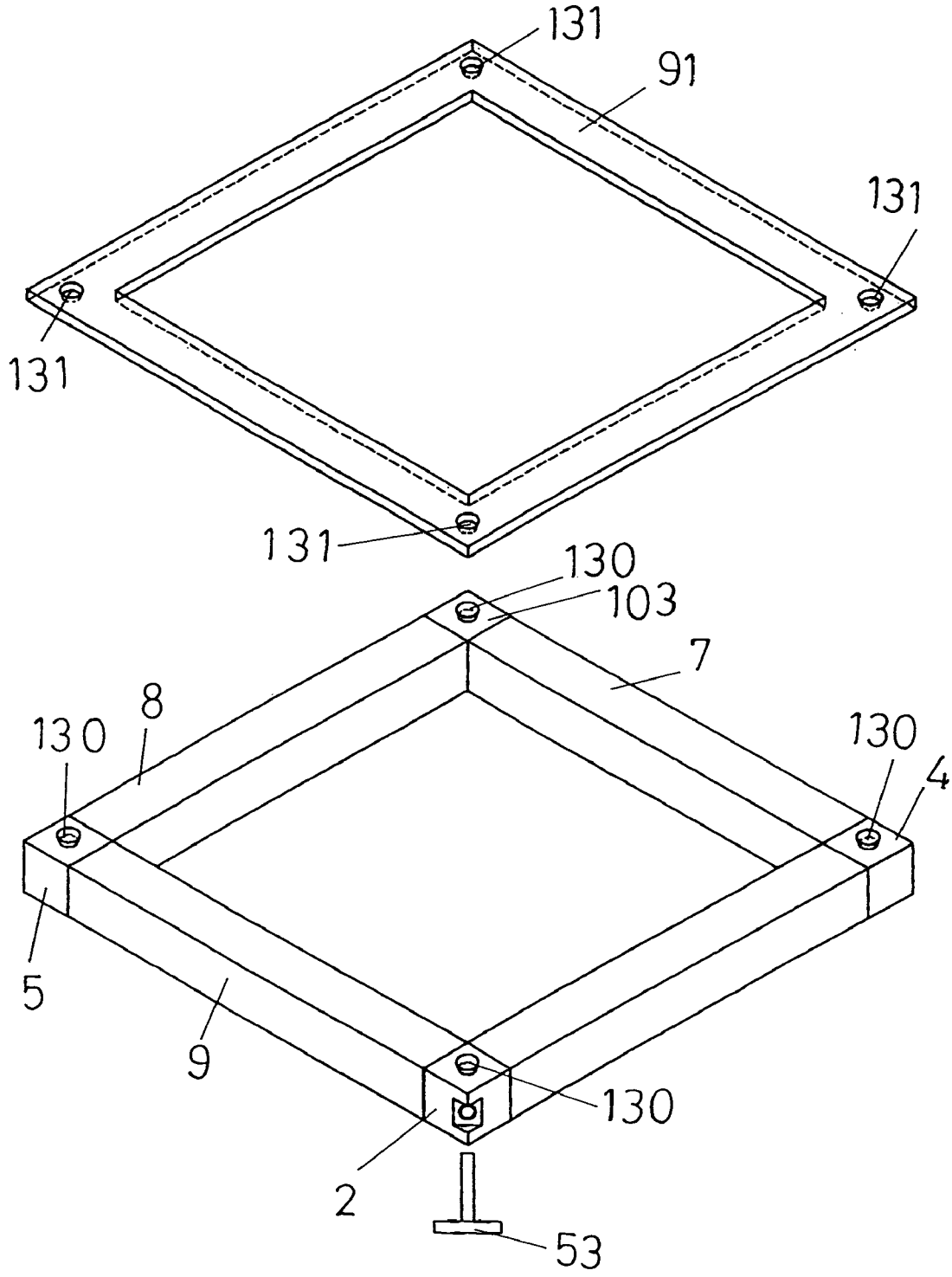
FIG. 25 is a schematic perspective view of the extension tool of the invention.

In a case where the sheet-shaped material to be stretched on the extension tool 1 of the sheet-shaped material is a metal sheet or a mesh-like material, and it is attached to the frame and anchoring holes 131 are disposed at four corners of the frame respectively, it is possible to prevent the application of unnecessary tension on the sheet-shaped material by designing so that the projection 130 is to be engaged with the anchoring hole on the upper side of each of the corner members 2, 3, 4 and 5 as shown in FIG. 25.

The extension tool of the sheet-shaped material according to the present invention can be applied as a tool for stretching various types of materials in a sheet shape, a mesh-like shape, a planar shape, a linear shape, etc. made of metal, resin, leather, etc.

For example, the following applications can be conceived:

The extension tool according to the present invention can be used as a tool to prepare a printing sheet where images are formed in the field of printing such as screen printing or as a tool to prepare a canvas for painting. In such cases, if the extension tool for the sheet-shaped material according to the present invention is used, the sheet-shaped material to be stretched can be easily attached or removed, which contributes to the reduction of the space used.

The extension tool of the present invention can be used as a frame body for a signboard display panel, a frame body for a printing display panel, a frame body for a picture frame, or a frame body to stretch posters or flags. In such cases, if the extension tool according to the present invention is used, the sheet-shaped material to be stretched can be easily attached or removed. This contributes to the reduction of the space used.

The extension tool of the present invention can also be used as a frame for a vacuum contact sheet or as a frame to stretch a photographic film.

Further, the extension tool can be used as a tool to stretch a display panel such as a liquid crystal display panel, a plasma display panel, an electroluminescence display panel, an organic electroluminescence display panel, a screen for image projection, or a light transmission panel for a stained glass, a light fixture, etc.

The extension tool of the present invention can be used as a tool to stretch a window frame, a tent, a window, a door, a screen door, a wall, a ceiling, a floor, a roof, a partition, etc. There are applications in the field of the architecture and building construction.

The extension tool of the present invention can be used as a stand or a rack such as a table, a shelf, or a rack to be used for drying various types of objects, a table where objects are loaded, or a tool to stretch a partition, a curtain, etc. There are applications used in furniture or household appliances.

The extension tool of the present invention can be used as a tool to stretch a mattress for a bed, or a chair seat. In this case, the hardness of the bed or the chair can be adjusted by changing the tension as desired.

The extension tool of the present invention can be used as a tool to stretch a mirror body. According to the extension tool for sheet-shaped material of the present invention, a material having a mirror-finish can be stretched by the tension as desired. In this case, sufficient flatness can be maintained, or the extension tool can adequately suit and match a large-size or a lightweight design.

The extension tool of the invention can be used as a tool to stretch an antenna.

In the fields of sports, the extension tool can be used when a gut of a racket is stretched or when a net for a trampoline is stretched or for the extension of a target or a repulsion wall for ball games or to stretch a barricade.

The extension tool of the invention can be used as a tool to stretch leather on a percussion instrument, a resonance plate of string instruments or keyboard instruments, or as a tool to stretch an object such as a speaker cone.

The extension tool of the invention can be used as a tool to stretch a wing or a propeller of an airplane, or a rotary vane for wind power generation.

The extension tool of the invention can also be used as a tool to stretch a net-like or a mesh-like material such as a fishing net, or a linear or string-like material to be used in the aquaculture. In such cases, it can be used as a tool to stretch these net-like, mesh-like, linear or string-like materials and to dry the materials placed on it. The extension tool can also be used for straining in cooking.

Further, the extension tool of the invention can be used in a lightweight panel used in the manufacture of an airplane. According to the extension tool of the present invention, it is advantageous in that the tension can be applied from all the directions to the sheet-shaped material to be stretched.

In addition, the mechanism of the extension tool of the present invention can be applied in the fields of mechanical tools such as a fastening tool, a separating tool, a vise, etc., or in the field of civil engineering including the tunnel construction, the shore or river-bank protection work, or the installation of pit props or mine timbers.

The invention claimed is:

1. An extension tool for a sheet-shaped material, said extension tool comprising:

four corner members being placed at the four corners of a rectangle;

four frame members, both ends of each of said frame members being supported by said corner members, each of said frame members being placed between two opposite corner members, being able to move in a direction toward the two opposite corner members, and being able to move in a direction approaching or in a direction away from the opposed frame member together with the two opposite corner members supporting both ends of the frame member in relation to the opposed frame member;

four solid rods, each passing through one of said frame members and placed between two opposite corner members, and each solid rod having collars at positions closer to the ends thereof; and elastic members, each being disposed between each of said collars and an outer edge of an adjacent one of said corner members so that the elastic members push one end of said solid rod in a direction toward the adjacent corner member and the other end of said solid rod in a direction toward the opposite one of said corner members, wherein each of said frame members has an anchoring element where a peripheral portion of the sheet-shaped material or a frame for stretching the sheet-shaped material is anchored; and wherein each of said four frame members is able to move in a direction toward and away from said opposite corner members and in an approaching direction or in a direction away from the opposed frame member.

2. An extension tool for a sheet-shaped material according to claim 1, wherein a set of the diagonally opposed corner members among said four corner members comprises a moving mechanism each, which abuts an end of said solid rod placed between the corner member and the opposite corner member and moves said solid rod in a direction toward the opposite corner member; and a transmission mechanism is provided, and by the action of said transmission mechanism, the movement of either one of two of said solid rods, which are extending toward the corner member opposite to the set of the diagonally opposed corner members provided with said moving mechanism, toward the opposite corner member is converted to the movement of the other solid rod in a direction away from said opposite corner member, and the movement of said either one of said solid rods in a direction away from said opposite corner member is followed by the movement of the other solid rod in a direction toward said opposite corner member.

3. An extension tool for a sheet-shaped material according to claim 1, wherein one of said four corner members comprises a moving mechanism, which is always abutted to an end of said solid rod placed between said corner member and the opposite corner member and moves said solid rod in a direction toward the opposite corner member;

each end of the two solid rods stretching toward a corner member placed at a diagonally opposed position to said corner member provided with the moving mechanism is fixed on said corner member; and a transmission mechanism is provided, and by the action of said transmission mechanism, the movement of either one of the two solid rods, which are extending toward the corner member opposite to said corner member provided with the moving mechanism, toward the opposite corner member is converted to the movement of the other solid rod in a direction away from said opposite corner member, and the movement of said either one of said solid rods in a direction away from said opposite corner member is followed by the movement of the other solid rod in a direction toward said opposite corner member.

4. An extension tool for a sheet-shaped material according to claim 1, wherein a set of the diagonally opposed corner members among said four corner members has a moving mechanism respectively, which abuts an end of said solid rod placed between the corner member and the opposite corner member and moves said solid rod in a direction toward the opposite corner member; and an end of each of said solid rods being disposed between the set of the diagonally opposed corner members provided each with said moving mechanism and the opposite corner members, said end being disposed toward said opposite corner member, is fixed on said opposite corner member respectively.

5. An extension tool for a sheet-shaped material according to claim 1, wherein one corner member among said four corner members is provided with a moving mechanism, which abuts an end of said solid rod disposed between said corner member and one of the opposite two corner members and moves said solid rod in a direction toward said one of the opposite corner members, and an end of said solid rod which is disposed between said corner member and the other of the opposite two corner members is fixedly connected thereto; and a transmission mechanism is provided, and by the action of said transmission mechanism, the movement of either one of the solid two rods, which are extending toward the corner member other than said corner member provided with said moving mechanism, is converted to the movement of the other solid rod in a direction away from the corner member, and movement of either one of said solid rods in a direction away from the corner member is followed by movement of the other solid rod in a direction toward the corner member.

6. An extension tool for a sheet-shaped material according to claim 1, wherein said moving mechanism is mounted at a corner of said corner member and has an insert, said insert being movable in a direction of said corner toward the center of a rectangle formed by said four corner members; and a forward end of said insert abuts an end of each rod closer to the corner member provided with said moving mechanism.

7. An extension tool for a sheet-shaped material according to claim 1, wherein said moving mechanism is mounted at a corner of said corner member and has an insert and a ball, said insert being movable in a direction of said corner toward the center of a rectangle formed by said four corner members; and said ball is movably disposed in a space formed by a forward end of said insert and ends of said solid rods, each of which is disposed between the corner member provided with said moving mechanism and the opposite corner member, each of said ends being closer to said corner member provided with said moving mechanism; and said ball is interposed between the forward end of said insert and an end of each of said solid rods so that said ball is abutted by the forward end of said insert and each end of solid rods, which is closer to said corner member provided with said moving mechanism.

8. An extension tool for a sheet-shaped material according to claim 6, wherein said corner member provided with said moving mechanism has a stopper to limit the movement amount of said insert moving toward the center of a rectangle formed by said four corner members.

9. An extension tool for a sheet-shaped material according to claim 1, wherein each of said frame members has a hollow interior portion; and said four solid rods pass through said frame members and are disposed between two opposite corner members, respectively, and each of said four solid rods is supported in said hollow portion by support elements arranged in the hollow portion of said respective frame member with a predetermined distance to each other between the two opposite corner members.

10. An extension tool for a sheet-shaped material according to claim 1, wherein said anchoring element is disposed at such a position that said anchoring element does not protrude from a plane defined by said frame members; and engaging projections, formed on said frame member, are not protruding from the plane defined by said frame members.

11. An extension tool for a sheet-shaped material according to claim 1, wherein each of said solid rods extends completely through said respective frame member.

12. An extension tool for a sheet-shaped material, said extension tool comprising:

four corner members being placed at four corners of a rectangle;

four frame members, both ends of each of said frame members being supported by two of said corner members that are disposed opposite to each other, each of said frame members being placed between the two opposite corner members, each of said frame members being able to move in a direction toward and away from the opposite corner members, and being able to move in a direction approaching or in a direction away from the opposed frame member together with the two opposite corner members supporting both ends of the frame member in relation to the opposed frame member;

four solid rods, each passing through one of said frame members and being placed between two opposite corner members, and each of said solid rods having collars at positions closer to the ends thereof; and elastic members, each being disposed between said collar and an outer edge of said corner member, and pushing one end of said solid rod in a direction toward said corner member and the other end of said solid rod in a direction toward said corner member, wherein;

each of said corner members has an anchoring element where an end portion of the sheet-shaped material or an end portion of a frame where the sheet-shaped material is stretched is anchored; and each of said four frame members is able to move in a direction toward said corner member between said opposite corner members and in an approaching direction toward or in a direction away from the opposed frame member.

13. An extension tool for a sheet-shaped material according to claim 12, wherein a set of the diagonally opposed corner members among said four corner members is provided with a moving mechanism, which abuts an end of said solid rod disposed between the corner member and the opposite corner member and moves said solid rod in a direction toward the opposite corner member; and a transmission mechanism is provided, and by the action of said transmission mechanism, the movement of either one of two of said solid rods, which are extending toward the corner member opposite to the set of the diagonally opposed corner members provided each with said moving mechanism, toward the opposite corner member is converted to movement of the other solid rod in a direction away from said opposite corner member, and movement of either one of solid rods in a direction away from said opposite corner member is followed by movement of the other solid rod in a direction toward said opposite corner member.

14. An extension tool for a sheet-shaped material according to claim 12, wherein one of said four corner members comprises a moving mechanism, which always abuts an end of said solid rod placed between said corner member and the opposite corner member and moves said solid rod in a direction toward the opposite corner member;

each end of the two solid rods extending toward a corner member placed at a diagonally opposed position to said corner member provided with the moving mechanism is fixed on said corner member; and a transmission mechanism is provided, and by the action of said transmission mechanism, movement of either one of the two solid rods, which are stretching toward the corner member opposite to said corner member provided with the moving mechanism, toward the opposite corner member is converted to movement of the other solid rod in a direction away from said opposite corner member, and the movement of either one of said solid rods in a direction away from said opposite corner member is followed by movement of the other solid rod in a direction toward said opposite corner member.

15. An extension tool for a sheet-shaped material according to claim 12, wherein a set of the diagonally opposed corner members among said four corner members is provided with moving mechanisms, respectively, and each of the moving mechanisms abuts an end of said solid rod placed between the corner member and the opposite corner member and moves said solid rod in a direction toward the opposite corner member; and an end of each of said solid rods being disposed between the set of the diagonally opposed corner members provided each with said moving mechanism and the opposite corner members, said end being disposed toward said opposite corner member, is fixed on said opposite corner member respectively.

16. An extension tool for a sheet-shaped material according to claim 12, wherein one corner member among said four corner members is provided with a moving mechanism, which abuts an end of said solid rod disposed between said corner member and one of the opposite two corner members and moves said solid rod in a direction toward said one of the opposite corner members, and an end of said solid rod, which is disposed between said corner member and the other of the opposite two corner members, is fixedly connected thereto; and a transmission mechanism is provided, and by the action of said transmission mechanism, movement of either one of said two solid rods, which are extending toward the corner member other than said corner member provided with said moving mechanism, is converted to movement of the other solid rod in a direction away from the corner member, and movement of either one of said solid rods in a direction away from the corner member is followed by movement of the other of said solid rods in a direction toward the corner member.

17. An extension tool for a sheet-shaped material according to claim 12, wherein said moving mechanism is mounted at a corner of said corner member and has an insert, said insert being movable in a direction of said corner toward the center of a rectangle formed by said four corner members; and a forward end of said insert abuts an end of each of said solid rods that is closer to the corner member provided with said moving mechanism.

18. An extension tool for a sheet-shaped material according to claim 12, wherein said moving mechanism is mounted at a corner of said corner member and has an insert and a ball, said insert being movable in a direction of said corner toward the center of a rectangle formed by said four corner members; and said ball is movably disposed in a space formed by a forward end of said insert and ends of said solid rods, each of which is disposed between the corner member provided with said moving mechanism and the opposite corner member, said ends being closer to said corner member provided with said moving mechanism; and said ball is interposed between the forward end of said insert and an end of each of said solid rods so that said ball abuts the forward end of said insert and each end of said solid rods, which is closer to said corner member provided with said moving mechanism.

19. An extension tool for a sheet-shaped material according to claim 18, wherein said corner member provided with said moving mechanism has a stopper to limit the amount of the movement of said insert moving toward the center of a rectangle formed by said four corner members.

20. An extension tool for a sheet-shaped material according to claim 12, wherein each of said frame members has a hollow portion inside; and said four solid rods pass through said frame members and are disposed between two opposite corner members, respectively, and each of said four solid rods is supported in said respective hollow portion by support elements arranged in the hollow portion of said respective frame member with a predetermined distance to each other between the two opposite corner members.

* * * * *